US007252547B2

(12) United States Patent
Nishide

(10) Patent No.: US 7,252,547 B2
(45) Date of Patent: Aug. 7, 2007

(54) CONNECTOR

(75) Inventor: Satoru Nishide, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/408,645

(22) Filed: Apr. 21, 2006

(65) Prior Publication Data

US 2006/0240693 A1 Oct. 26, 2006

(30) Foreign Application Priority Data

Apr. 22, 2005 (JP) ..... 2005-125406

(51) Int. Cl.
*H01R 13/40* (2006.01)

(52) U.S. Cl. ..... 439/587; 439/275

(58) Field of Classification Search ..... 439/157, 439/271, 272, 587, 589, 274, 275
See application file for complete search history.

(56) References Cited

U.S. PATENT DOCUMENTS 5,613,868 A * 3/1997 Ohsumi et al. ..... 439/275
6,398,585 B1 * 6/2002 Fukuda ..... 439/587
6,739,908 B2 * 5/2004 Hamai et al. ..... 439/587
6,767,250 B2 * 7/2004 Casses et al. ..... 439/587
7,114,991 B2 * 10/2006 Shiga et al. ..... 439/587
2002/0002000 A1 * 1/2002 Okamura et al. ..... 439/587
2002/0177359 A1 * 11/2002 Fukatsu et al. ..... 439/587
2004/0092163 A1 * 5/2004 Nagayasu et al. ..... 439/587

FOREIGN PATENT DOCUMENTS

JP 10-3963 1/1998

* cited by examiner

*Primary Examiner*—Hien Vu
(74) *Attorney, Agent, or Firm*—Gerald E. Hespos; Anthony J. Casella

(57) ABSTRACT

A connector has a female housing (10). A space (12S) is formed at the rear of the housing (10) for accommodating a seal (40) and terminal accommodating chambers (11A) extend forward from the space (12S). A rear holder (50) is mounted on the rear of the female housing (10) for holding the seal (40) in the space (12S). A lever (70) is mounted on the rear holder (50) and can generate a cam action for connecting the female housing (10) and a mating male housing (80). The lever (70) can be moved further after the housings (10, 80) are connected for moving the rear holder (50). Thus, the rear holder (50) compresses the seal (40) into engagement with wires that extend from the female housing (10).

5 Claims, 27 Drawing Sheets

CONNECTOR

BACKGROUND OF THE INVENTION

1. Field of the Invention

The invention relates to a connector.

2. Description of the Related Art

Japanese Unexamined Patent Publication No. H10-3963 discloses a connector with a housing that has a terminal accommodating portion for accommodating terminal fittings. A sealing plug is fit into a plug mounting hole formed in the rear surface of the housing and a rear holder is attached to the rear surface of the sealing plug to prevent the sealing plug from coming out. Pivot shafts project from the opposite side surfaces of the housing and a lever is mounted rotatably on the shafts.

The housing has a complicated construction due to the terminal accommodating portion, the pivot shafts and the like. Thus, a complicated mold is required to form the housing.

Further, for the exchange of the lever, requires the uneconomical exchange of the housing.

The present invention was developed in view of the above problems, an object thereof is to simplify the construction of a mold for forming a connector housing and to make it, unnecessary to exchange the connector housing when exchanging a movable member.

SUMMARY OF THE INVENTION

The invention relates to a connector with a housing that has terminal accommodating chambers for accommodating terminal fittings. The connector also has a movable member for developing a cam action to connect the housing with a mating housing. A rear member is formed separately from the housing, but is mountable on a rear part of the housing. Insertion openings extend through the rear member, and the terminal fittings are insertable through the insertion openings in substantially the same direction as an inserting direction of the terminal fittings into the terminal accommodating chambers. The movable member is assembled directly or indirectly with the rear member. Thus, a construction necessary to assemble the movable member is on the rear member, and is separate from the housing. As a result, the mold for forming the housing can be simplified. Further, it is not necessary to exchange the housing when exchanging the movable member.

The movable member preferably is a lever displaying the cam action by guiding a cam pin on the mating housing along a cam groove in the lever.

An accommodation space is provided at the rear of the housing and has an inner peripheral sealing surface. A seal is accommodated in the accommodation space and closely contacts the sealing surface.

The seal preferably has wire insertion holes that normally are in a large-diameter state for receiving the terminal fittings and wires.

The rear member preferably is a rear holder with a pressing surface for pressing and holding the seal. The rear holder also has insertion openings for loosely receiving the terminal fittings and the wires.

The rear holder preferably compresses the seal in the thickness for narrowing the wire insertion holes. As a result, the inner surfaces of the wire insertion holes closely contact the wires. The pressing surface of the rear holder preferably compresses the seal after a connecting operation of the two housings is completed by operating the movable member.

The wire insertion holes of the seal are in the large-diameter state before the lever is rotated. Thus, the terminal fittings and the wires can be inserted easily through the insertion holes. The lever then is rotated to connect the housings and to move the rear holder forward after the housings are connected. The pressing surface of the rear holder compresses the seal as the rear holder moves forward. As a result, the wire insertion holes are deformed to smaller diameters and the inner circumferential surfaces of the wire insertion holes closely contact and seal to the wires.

The large diameters for the wire insertion holes can be set in correspondence with larger terminal fittings. Therefore, the inner circumferential surfaces of the wire insertion holes and the hole edges of the seal are not damaged as the terminal fittings are inserted.

The rear holder has a side that is displaceable along the outer peripheral surface of the rear part of the housing while the compression of the seal is in progress. Accordingly, a degree of compression of the seal can be confirmed visually by observing a moving stroke of the side of the rear holder.

In some instances, no seal is accommodated in the accommodation space. In these instances, a second rear member is provided and has a base that is fit in the accommodation space. The base of the second rear member has insertion paths corresponding to the terminal accommodating chambers.

The seal and the first of the above described rear members are selected if the connector must be watertight. However, the second rear member is selected if the connector need not be watertight. Accordingly, one of the first and second rear members is mounted on the housing depending on whether the connector must be watertight. Thus, the same housing can be used for both cases, and the number of parts is reduced.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
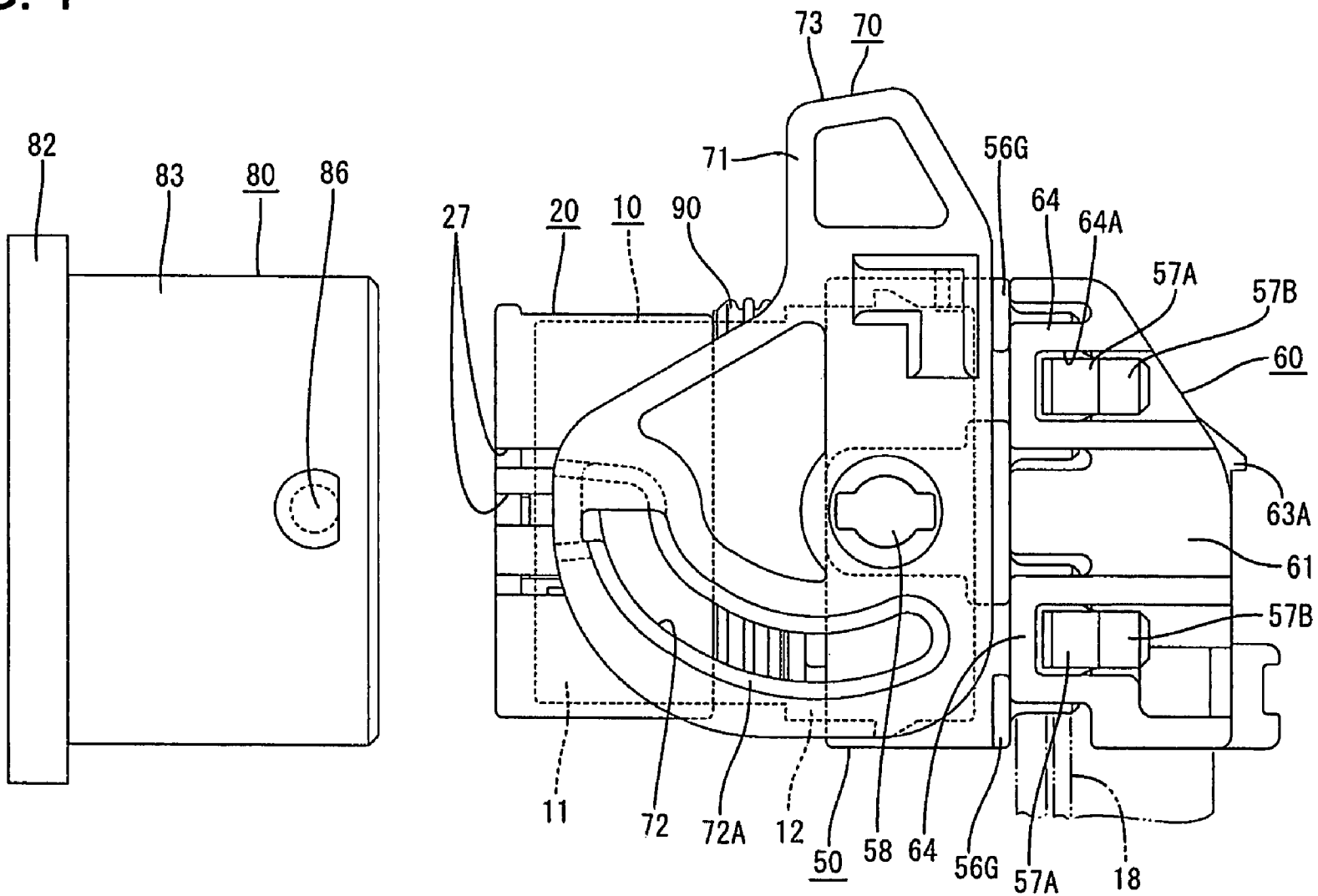
FIG. 1 is a plan view showing a state before a female housing is connected with a mating male housing in a first embodiment.
Figure 2:
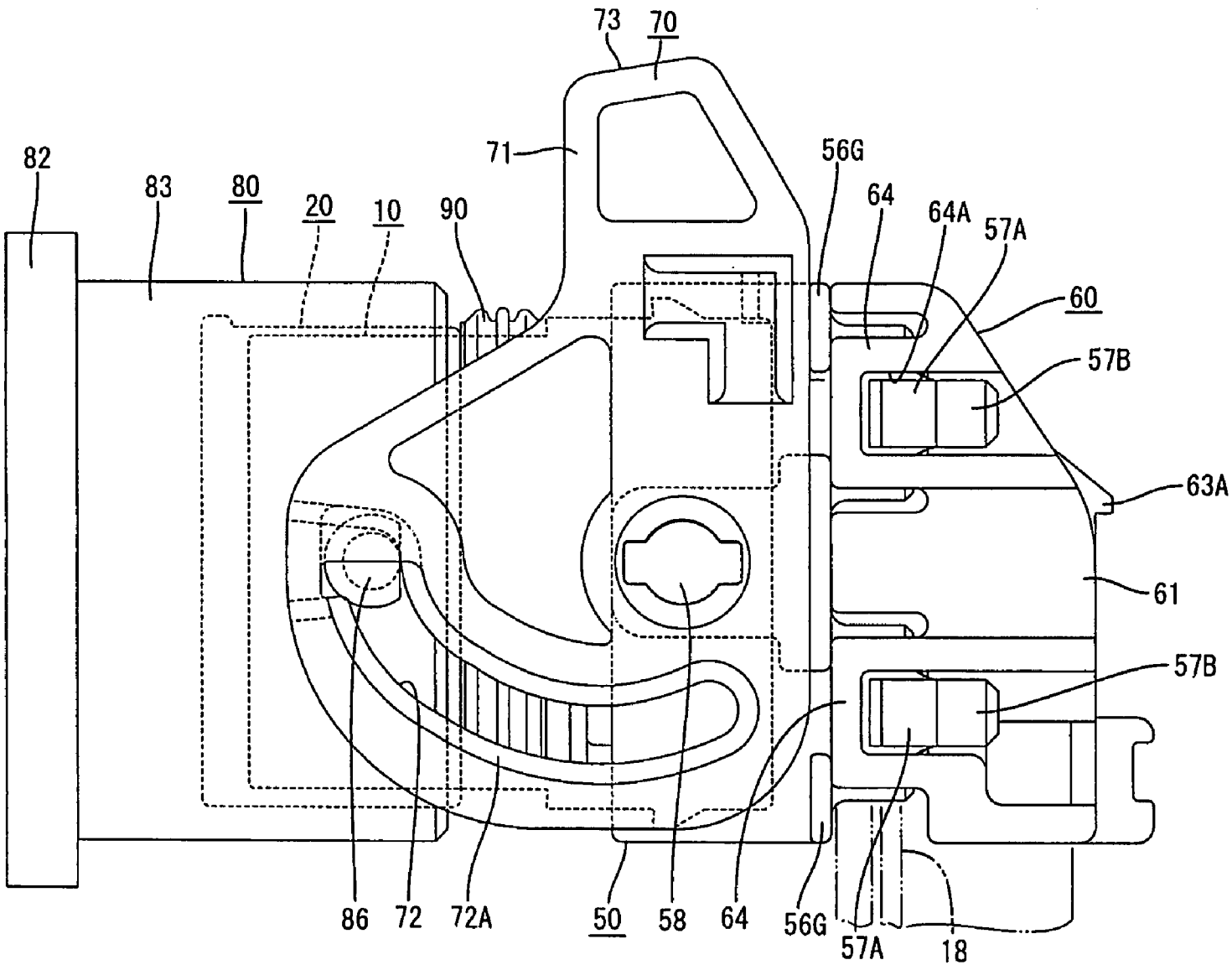
FIG. 2 is a plan view showing a state where a lever is at a rotation starting position and cam pins are located at the entrances of cam grooves.
Figure 3:
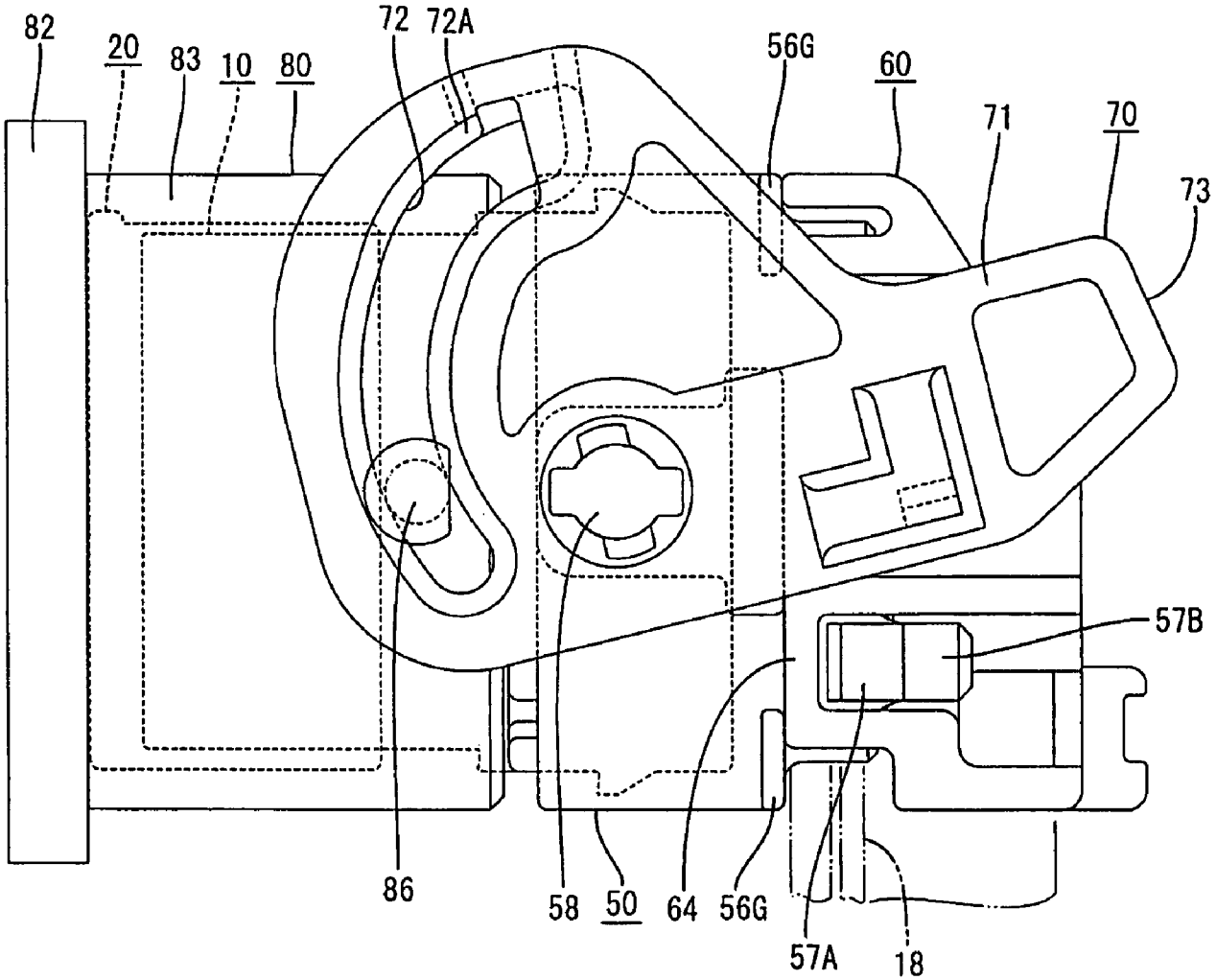
FIG. 3 is a plan view showing an intermediate state during the rotation of the lever.
Figure 4:
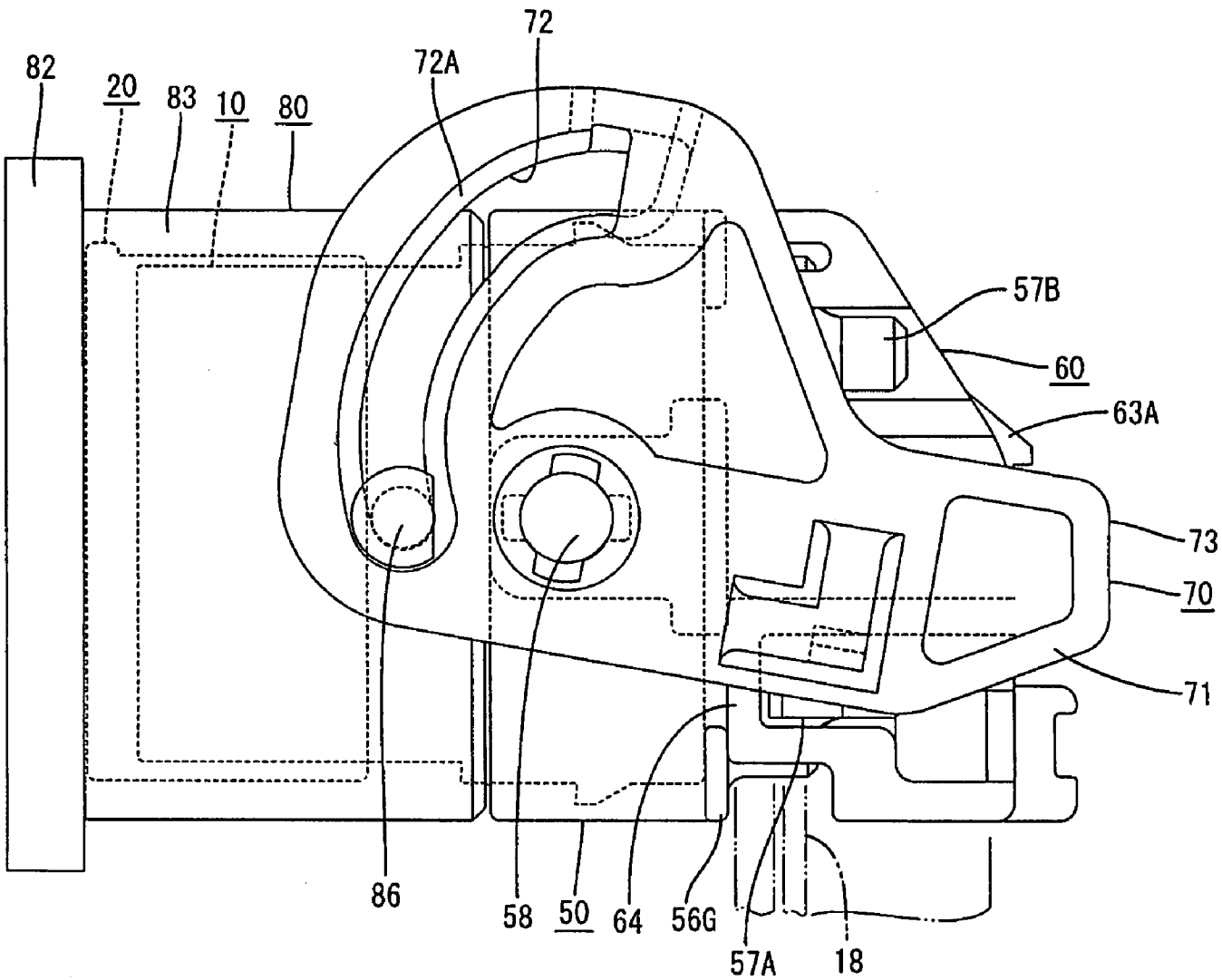
FIG. 4 is a plan view showing the lever at a rotation ending position.

A connector in accordance with the invention is described with reference to FIGS. 1 to 25. The connector has a female housing 10, a front mask 20, a retainer 30, a seal 40, a rear holder 50, a lever 70, and a wire cover 60. The female housing 10 is connectable with a male housing 80 of a mating connector. Both female and male housings 10, 80, the front mask 20, the retainer 30, the rear holder 50, the lever 70 and the wire cover 60 are made of synthetic resin, and the seal 40 preferably is made of a resilient material such as a rubber. In the following description, ends of the two housings 10, 80 to be connected are referred to as front ends.

Figure 9:
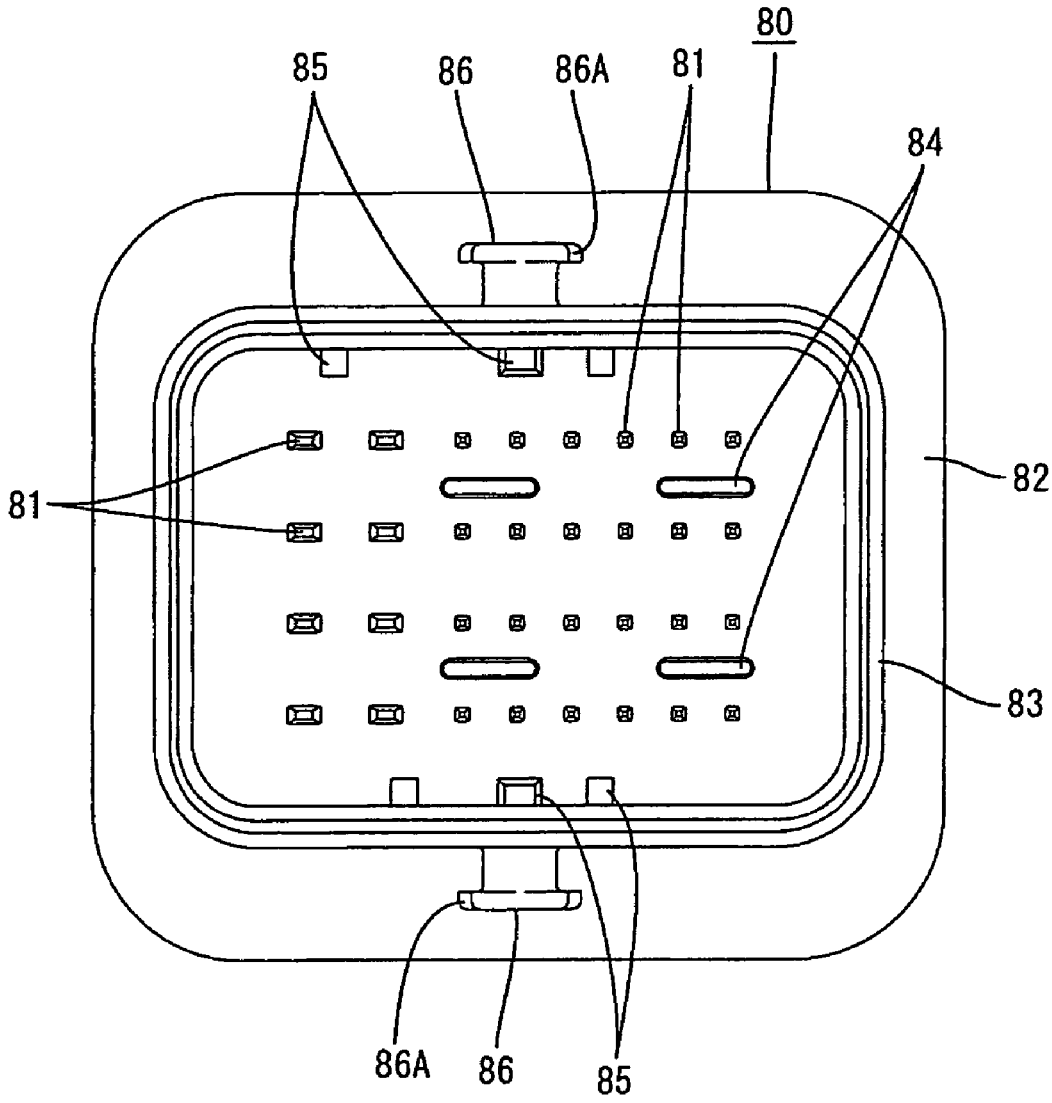
FIG. 9 is a front view of the mating male housing.

As shown in FIGS. 1 and 9, the mating male housing 80 has a terminal mounting portion 82 in which tabs 81 of male terminal fittings with forwardly projecting tabs 81. More particularly, the male housing 80 has a terminal mounting portion 82 for receiving the male terminal fittings. A rectangular tubular receptacle 83 projects forward from the front surface of the terminal mounting portion 82, and the tabs 81 project forward in the receptacle 83. The tabs 81 are aligned in rows and the dimensions of the tabs 81 substantially correspond to amounts of current flowing therethrough. The tabs 81 in the two rows at the right are wider than those in six rows at the left. Error-assembling preventing ribs 84 also project in the receptacle 83. The error-assembling preventing ribs 84 interfere with the front surface of the female housing 10 when one of the two housings 10, 80 is held in an improper orientation (such as upside down) with respect to the other and hinder any further connecting of the two housings 10, 80.

The female housing 10 is fittable into the receptacle 83, and guiding ribs 85 extend in substantially forward and backward directions on the inner peripheral surface of the receptacle 83 for guiding the connecting operation with the female housing 10. Upper and lower cam pins 86 project at positions near the front ends of substantially widthwise middle parts of the upper and lower outer surfaces of the receptacle 83. Each cam pin 86 has a substantially cylindrical shape with a large-diameter flange 86A at its projecting end, and is movable substantially along a corresponding cam groove 72 formed in a side plate 71 of the lever 70.

Figure 10:
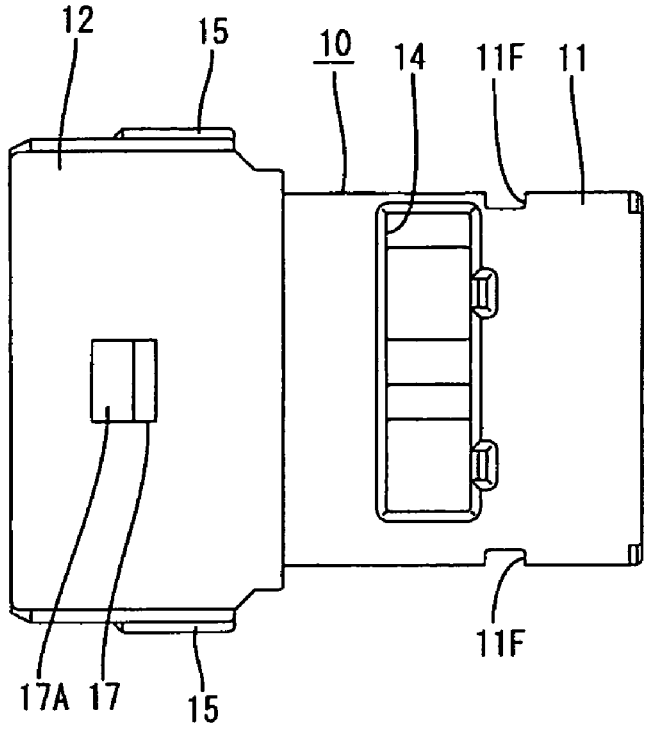
FIG. 10 is a right side view and a front view of the female housing.
Figure 10:
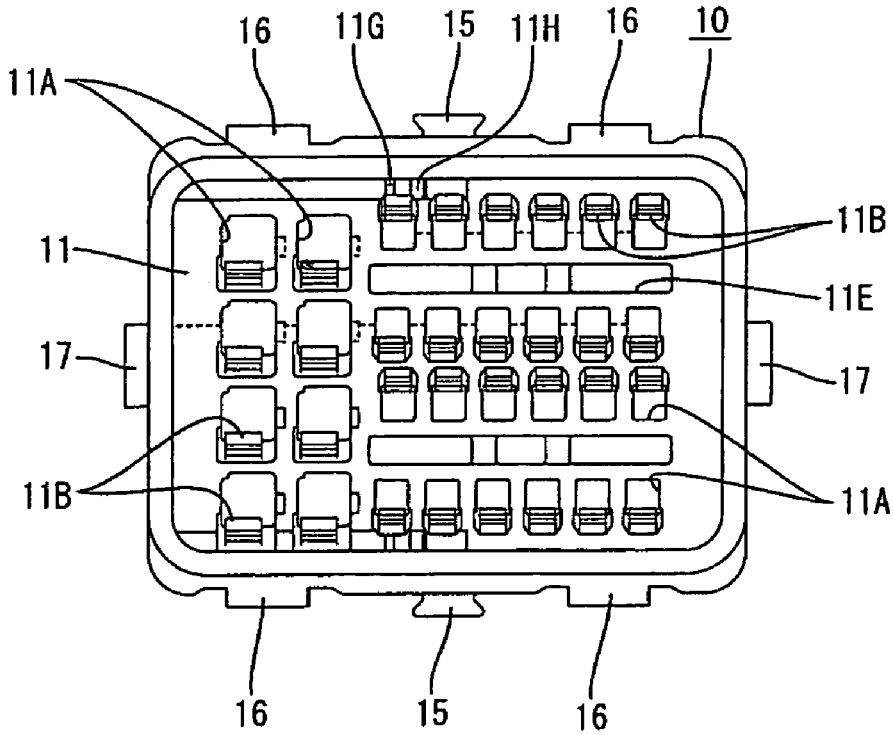
Figure 11:
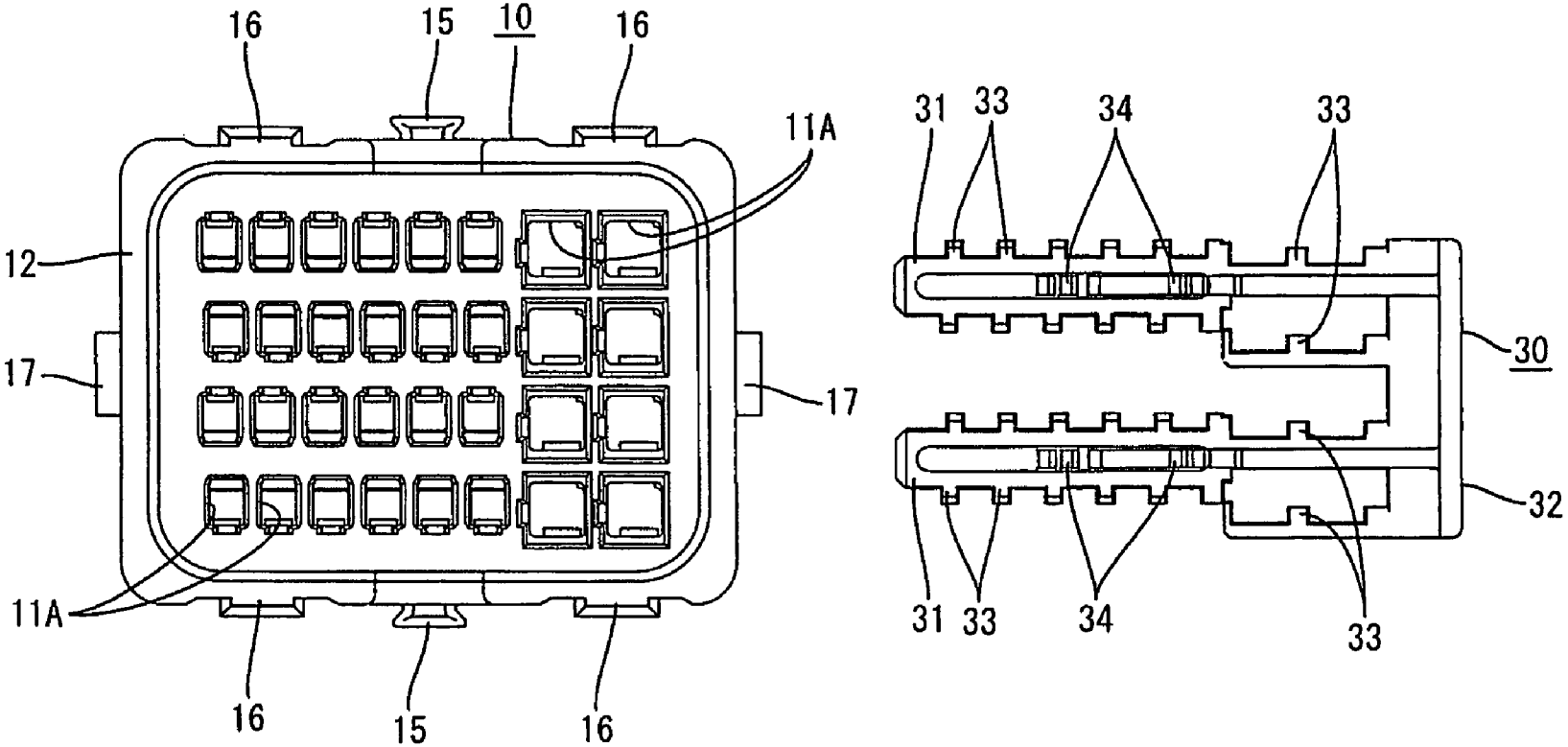
FIG. 11 is rear views of a retainer and the female housing.

As shown in FIGS. 10 and 11, the female housing 10 has a substantially rectangular block shaped terminal accommodating portion 11 formed with terminal accommodating chambers 11A. A fittable tube 12 projects back from the rear surface of the terminal accommodating portion 11 and defines a substantially rectangular tube that is larger than the terminal accommodating portion 11 and. The terminal accommodating portion 11 preferably takes up more than about half, more preferably almost two-thirds of the length of the female housing 10, and the fittable tube 12 preferably takes up less than about half, more preferably the remaining one-third.

Figure 25:
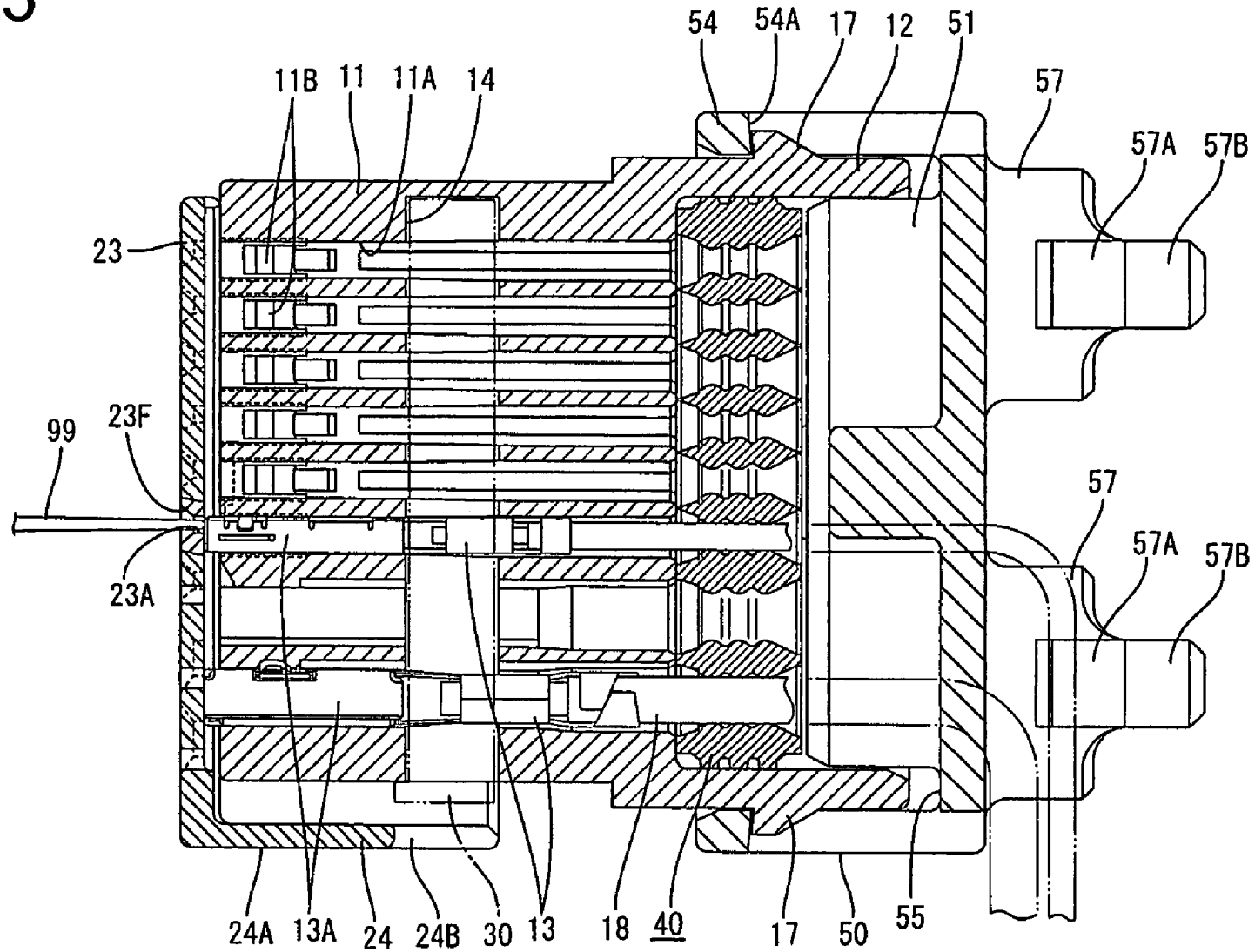
FIG. 25 is a horizontal section showing a state where an electrical connection test is conducted by inserting a jig through a tab insertion opening.

Female terminal fittings 13 are inserted into the terminal accommodating chambers 11A from behind, and engage resilient locks 11B that project from the inner peripheral surfaces of the terminal accommodating chambers 11A (see FIG. 25). The female terminal fittings 13 in the terminal accommodating chambers 11A aligned in two rows at the right side of the terminal accommodating portion 11 have large box portions 13A, whereas those in the terminal accommodating chambers 11A aligned in the six rows at the left side of the terminal accommodating portion 11 have small box portions 13A. The tabs 81 enter the box portions 13A of the female terminal fittings 13 as the two housings 10, 80 are connected to establish electrical connections between the mating terminal fittings. Laterally-extending preventing-rib receiving grooves 11E are formed in the front surface at the left side of the terminal accommodating portion 11 where the six rows of the terminal accommodating chambers 11A are aligned. The preventing-rib receiving grooves 11E are configured to receive the error-assembling preventing ribs 84.

A connector seal 90 is mounted from the front on the outer peripheral surface of the terminal accommodating portion 11 and is positioned at a step 19 between the terminal accommodating portion 11 and the fittable tube 12. The connector seal 90 has a substantially rectangular ring shape and is made of a resilient material, such as a rubber, to provide sealing between the female housing 10 and the front mask 20. Upper and lower guiding grooves 11F extend substantially in the width direction at positions near the front ends of the upper and lower surfaces of the terminal accommodating portion 11 and receive elongated guiding projections 21 in the front mask 20.

A substantially rectangular retainer mount hole 14 is formed in the right surface of the terminal accommodating portion 11. The retainer mount hole 14 has a depth to communicate with all of the terminal accommodating chambers 11A.

Partial locking projections 11G and full locking projections 11H for the front mask 20 are formed substantially side by side at the upper and bottom ends of a substantially widthwise middle part of the front surface of the terminal accommodating portion 11. Recesses are formed at the substantially opposite sides of the partial and full locking projections 11G, 11H to receive locking claws 22 of the front mask 20. Thus, the front mask 20 can be held at a partial locking position and at a full locking position.

An accommodation space 12S is formed in the fittable tube 12 for receiving the seal 40 (see FIG. 24), and the inner peripheral surface of the accommodation space 12S is held in close contact with the outer peripheral surface of the seal 40. The seal 40 is accommodated in a substantially a front-half area of the fittable tube 12, and a base 51 of the rear holder 50 is accommodated into a rear area of the fittable tube 12 (see FIG. 25).

Engaging ribs 15 are formed at the front ends of substantially widthwise middle parts of both upper and bottom surfaces of the fittable tube 12 and extend in substantially forward and backward directions. The engaging ribs 15 have a dovetailed or undercut shape widened towards the projecting end and can slide along rib receiving grooves 52 in the rear holder 50. Left and right guides 16 are formed at the opposite sides of the engaging rib 15 on each of the upper and lower surfaces of the fittable tube 12 and extend in forward and backward directions. The guides 16 slide along guidable grooves 53 formed in the rear holder 50 to guide a mounting operation of the rear holder 50.

Left and right locking projections 17 are formed at substantially middle parts of the opposite side surfaces of the fittable tube 12 with respect to the height direction. Engaging portions 54 are formed at the rear holder 50 and resiliently engage the locking projections 17 to prevent the holder 50 from coming off backward. Slanted surfaces 17A are formed at the rear of the locking projections 17 and slope in and towards the back. The engaging portions 54 slide smoothly on the slanted surfaces 17A during the mounting of the rear holder 50.

Figure 12:
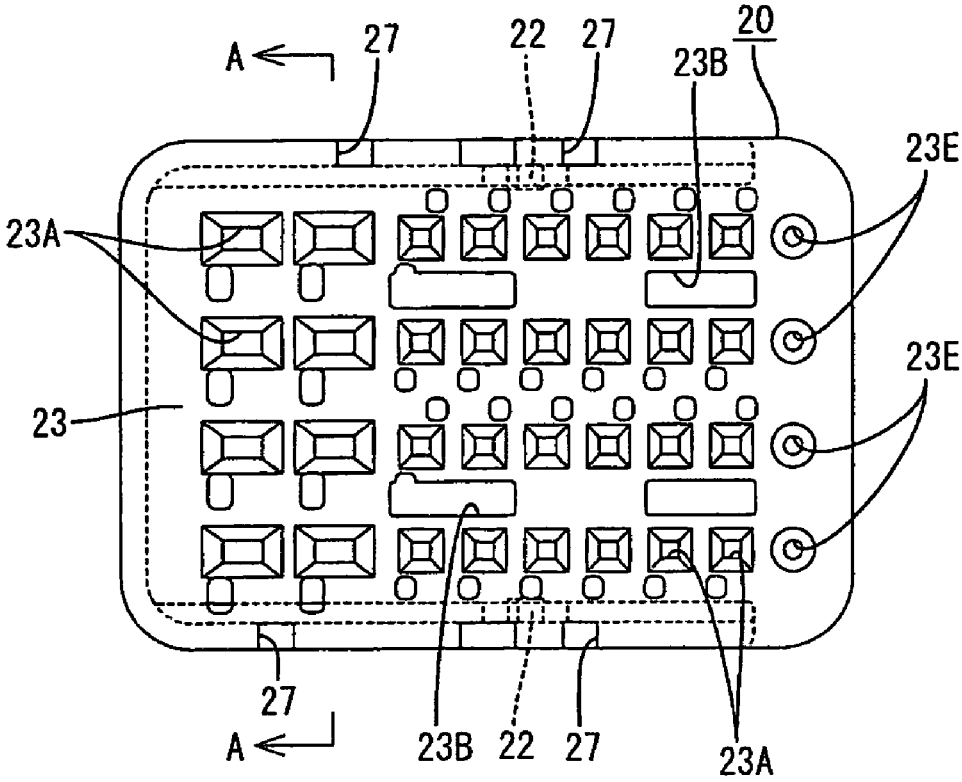
FIG. 12 is a front view and a section along A-A of the front view showing a front mask.
Figure 12:
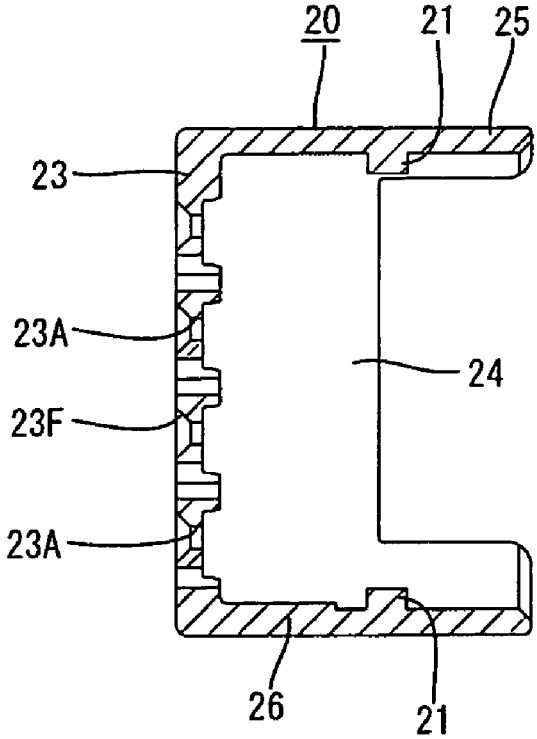

As shown in FIG. 12, the front mask 20 has a front plate 23 for substantially covering the front surface of the terminal accommodating portion 11. A side plate 24 projects back from the right edge of the front plate 23. A ceiling plate 25 and a bottom plate 26 project back farther than the side plate 24 and are connected with the upper and lower ends of the front plate 23 and the upper and lower ends of the side plate 24.

The front plate 23 has tab insertion openings 23A at positions corresponding to the tabs 81 of the male housing 80. The tab insertion openings 23A communicate with the corresponding terminal accommodating chambers 11A. The front plate 23 also has rib insertion openings 23B at positions corresponding to the error-assembling preventing ribs 84 of the male housing 80. The rib insertion openings 23B communicate with the corresponding preventing-rib receiving grooves 11E. Substantially round jig insertion openings 23E are substantially vertically aligned in a row at the right end of the front plate 23 and can receive a jig or probe pin for an electrical connection test.

Upper and lower locking claws 22 are formed at upper and bottom ends of a substantially a widthwise middle part of the rear surface of the front plate 23. The front mask 20 is displaceable between a partial locking position and a full locking position by movements of the front plate 23 substantially along the width direction along the front surface of the female housing 10. In this case, the front mask 20 is held at the partial locking position by the resilient engagement of the locking claws 22 with the partial locking projections 11G of the terminal accommodating portion 11 or is held at the full locking position by the resilient engagement of the locking claws 22 with the full locking projections 11H of the terminal accommodation portion 11.

Figure 22:
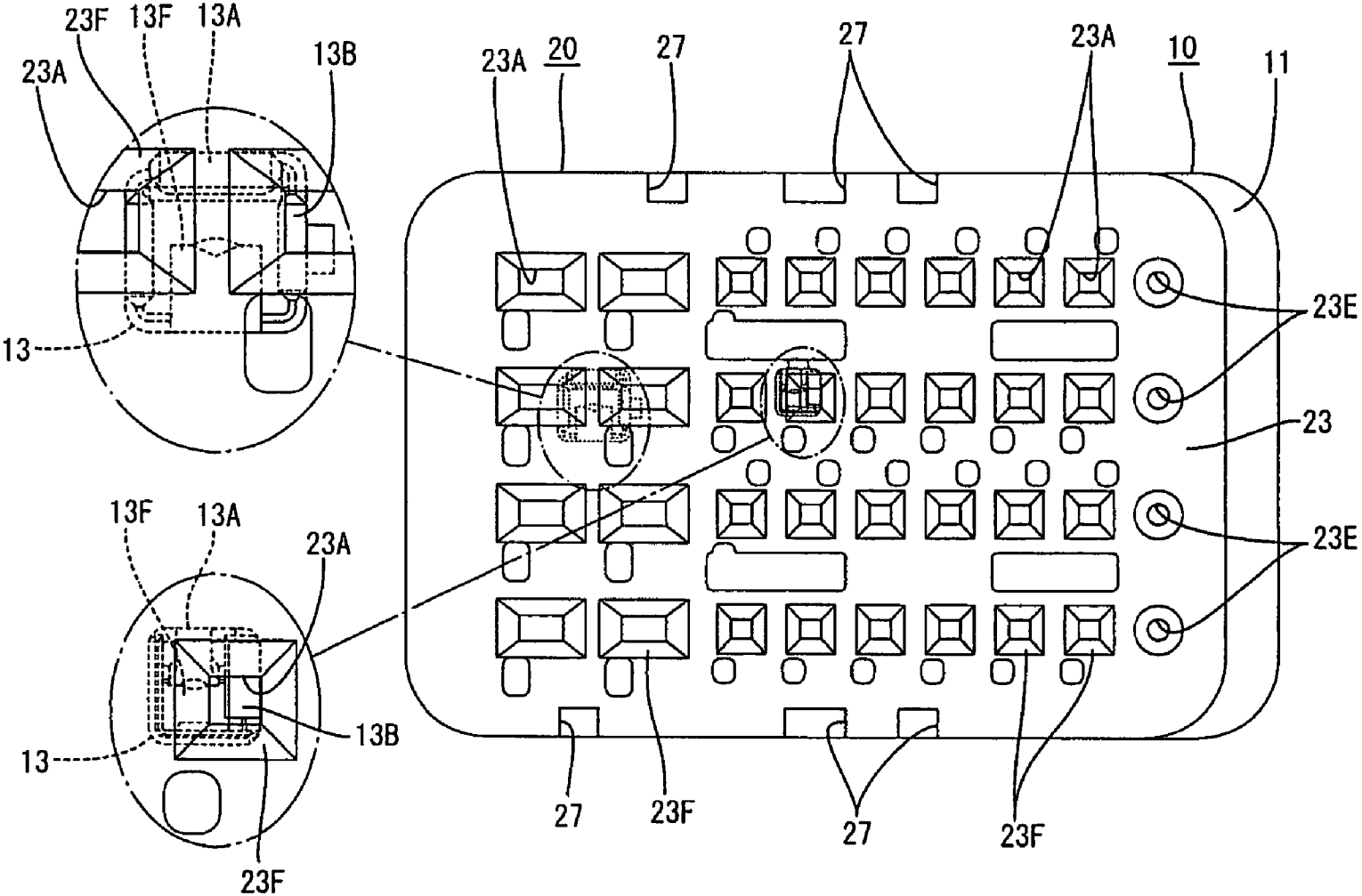
FIG. 22 is a front view of the front mask at a partial locking position.
Figure 23:
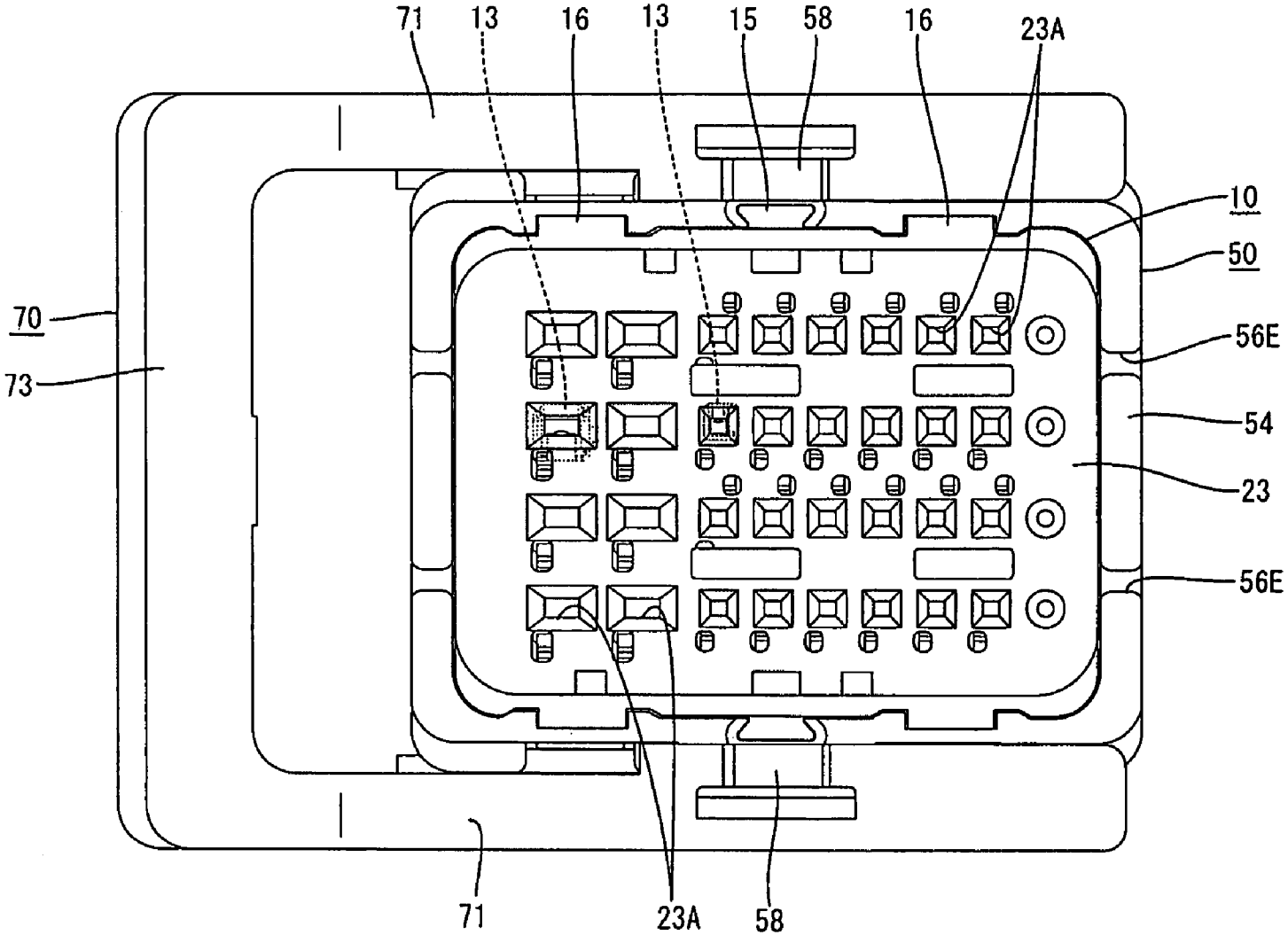
FIG. 23 is a front view of a connector.

The tab insertion openings 23A of the front plate 23 are displaced slightly along the width direction from the front openings of the terminal accommodating chambers 11A when the front mask 20 is at the partial locking position shown in FIG. 22. Additionally, front walls 13B of the box portions 13A of the female terminal fittings 13 in the terminal accommodating chambers 11A face the tab insertion openings 23A. A jig 99 for an electrical connection test can be inserted through the tab insertion opening 23A and into contact with the front wall 13B of the box portion 13A of the female terminal fitting 13, as shown in FIG. 25, while the front mask 20 is partly locked. Thus, the front plate 23 of the front mask 20 does not need separate jig insertion openings 23E for each terminal accommodating chamber 11A. The leading end of the jig 99 does not contact a tongue 13F in the box portion 13A, and hence cannot plastically deform the tongue 13F. Further, a tapered guiding surface 23F is formed around the opening edge of each tab insertion opening 23A. Thus, the leading end of the jig 99 can be guided smoothly and accurately to the front wall 13B of the box portion 13A. When the front mask 20 is at the partial locking position, the corresponding tab insertion openings 23A are not before the female terminal fittings 13 in the terminal accommodating chambers 11A at the rightmost end. Therefore, the electrical connection test is conducted by passing the jig 99 through the jig insertion openings 23E for exclusive use.

The tab insertion openings 23A of the front plate 23 align with the front openings of the terminal accommodating chambers 11A when the front mask 20 is at the full locking position. As a result, the tabs 81 can be inserted through the tab insertion openings 23A and into the terminal accommodating chambers 11A. Deformation spaces for the locks 11B are formed during the molding of the female housing 11 and necessarily leave openings at the front surface of the terminal accommodating portion 11. The front plate 23 of the front mask closes the front ends of the deformation spaces of the locks 11B when the front mask 20 reaches the full locking position. Thus, external matter cannot intrude into the deformation spaces and inadvertently deform the locks 11B.

An operating surface 24A is formed at the outer side surface of the side plate 24 and can be pushed for moving the front mask 20 from the partial locking position to the full locking position. The side plate 24 contacts the right surface of the terminal accommodating portion 11 and is immediately before the opening edge of the retainer mount hole 14 when the front mask 20 reaches the full locking position. A retainer introducing recess 24B is formed at a rear side of the side plate 24 for permitting the insertion of the retainer 30.

Upper and lower elongated guiding projections 21 are formed at substantially middle parts of the ceiling plate 25 and the bottom plate 26 with respect to forward and backward directions and extend along the width direction. The guiding projections 21 slide along the guiding grooves 11F of the terminal accommodating portion 11 to guide a sliding movement of the front mask 20. Guiding-rib receiving grooves 27 are formed at positions on the ceiling plate 25 and the bottom plate 26 corresponding to the guiding ribs 85 of the male housing 80 and extend in forward and backward directions. The guiding ribs 85 move along the guiding-rib receiving grooves 27 to guide the connecting operation of the two housings 10, 80. The rear edges of the ceiling plate 25 and the bottom plate 26 are attached to the front edges of the upper and lower sides of the connector seal 90, so that the connector seal 90 can be held tightly between these rear edges and the step 19.

Figure 24:
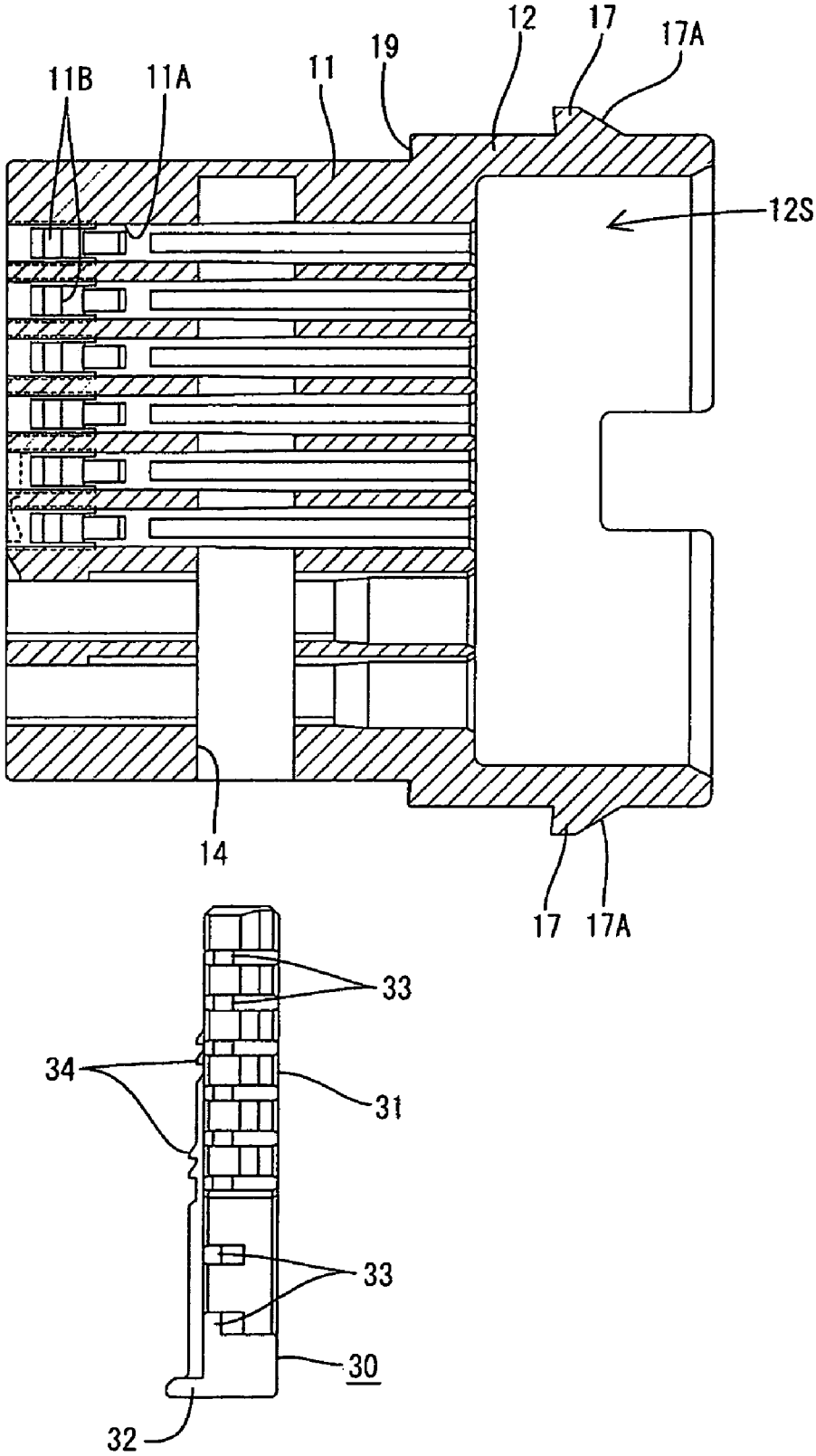
FIG. 24 is horizontal section of the female housing and the retainer.

As shown in FIGS. 11 and 24, the retainer 30 is a side type retainer, and has upper and lower substantially parallel arms 31 that project from a rectangular plate-shaped operating portion 32. The operating portion 32 is configured to close the retainer mount hole 14.

The arms 31 are substantially comb-shaped and side-by-side locking protrusions 33 project from the arms 31 at specified intervals corresponding to the arrangement of the terminal accommodating chambers 11A. More particularly, two rows at the base end correspond to the large-size female terminal fittings 13 and six rows at the leading side correspond to the small-size female terminal fittings 13. Locking structures 34 are formed along the width direction on the front surfaces of both arms 31. The retainer 30 can be held at a partial locking position and a full locking position by the engagement of the locking structures 34 with engaging structures (not shown) in the terminal accommodating portion 11.

The operating portion 32 is spaced from the opening of the retainer mount hole 14 and the locking protrusions 33 are retracted sideways from the terminal accommodating chambers 11A when the retainer 30 is at the partial locking position. On the other hand, the operating portion 32 closes the opening of the retainer mount hole 14 and the locking protrusions 33 enter the terminal accommodating chambers 11A when the operating portion 32 is pushed sufficiently for retainer 30 to reach the full locking position. At this time, the locking protrusions 33 engage jaws 13G at the rear ends of the box portions 13A if the female terminal fittings 13 are inserted properly in the terminal accommodating chambers 11A. As a result, the female terminal fittings 13 are locked doubly by the locks 11B and the retainer 30.

Figure 13:
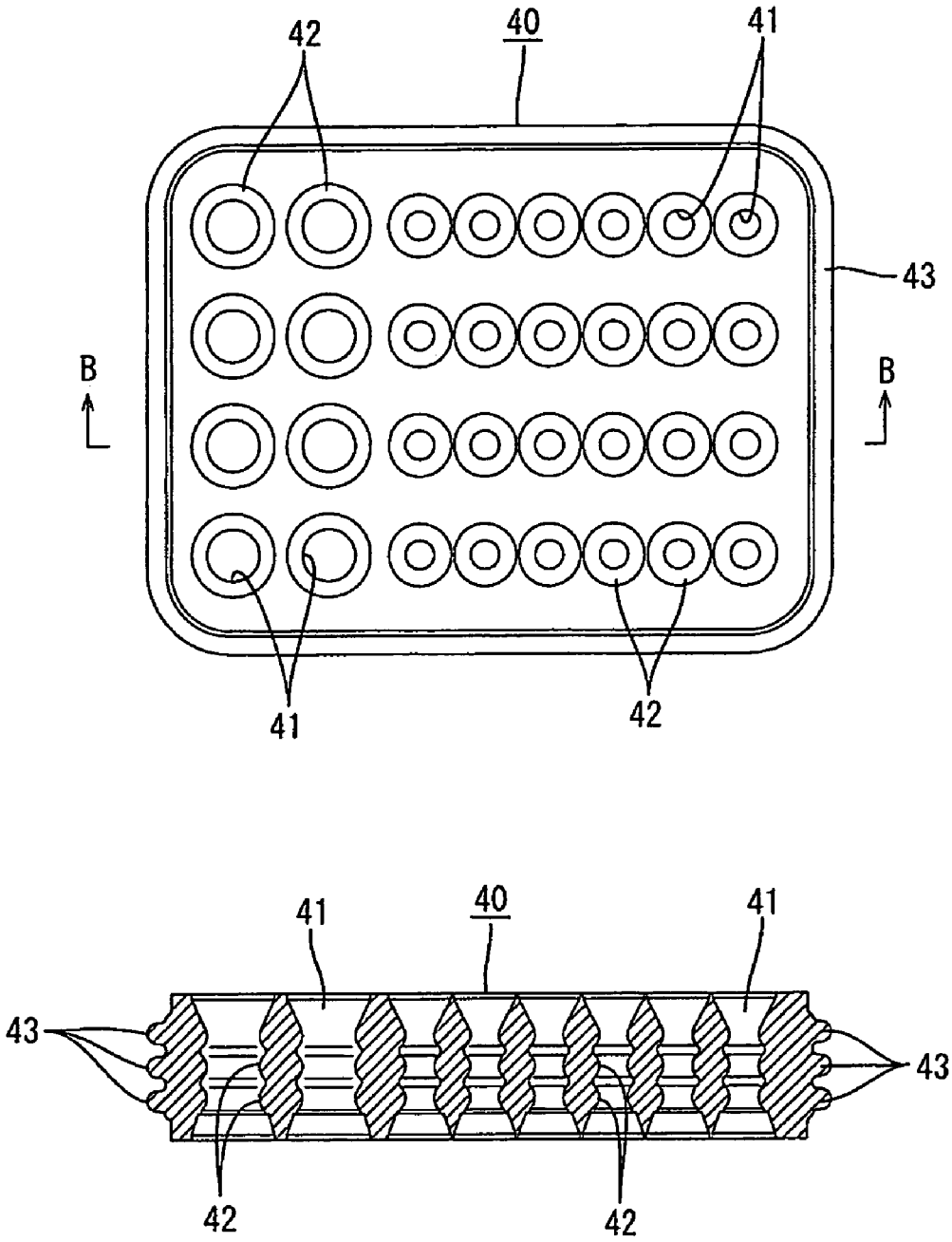
FIG. 13 is a front view and a section along B-B of the front view showing the seal.
Figure 14:
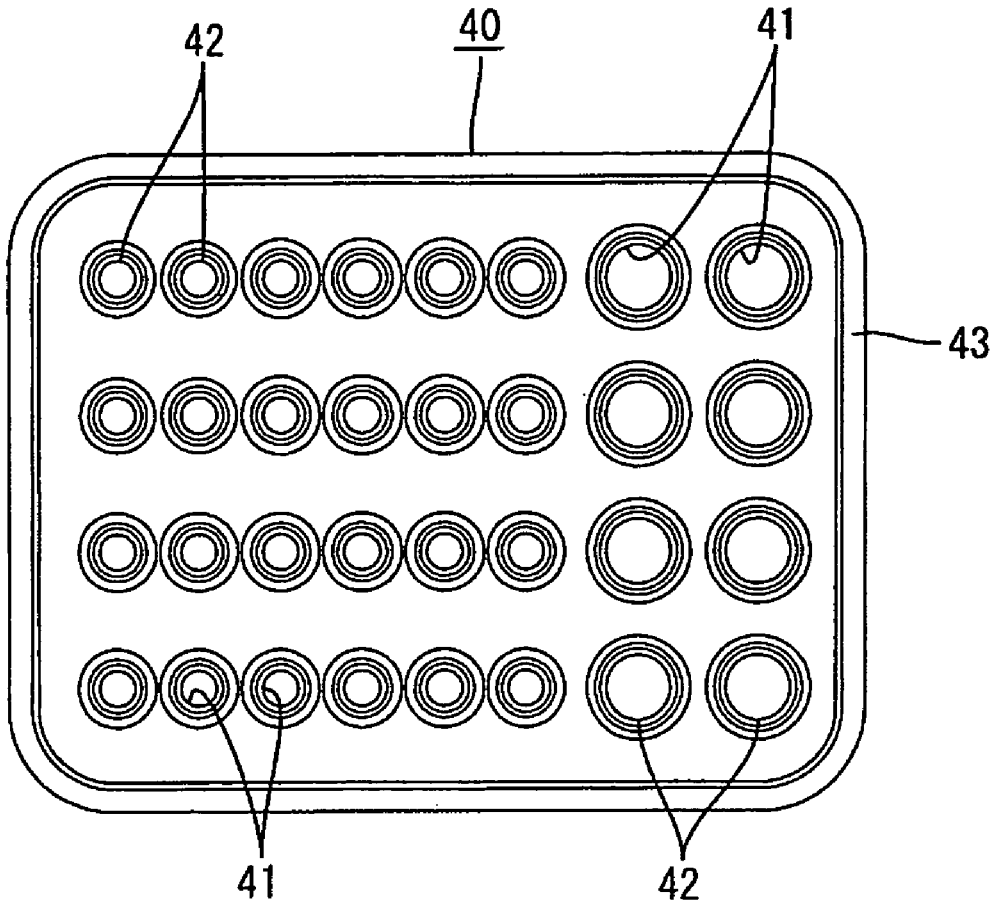
FIG. 14 is a rear view of the sealing member.

As shown in FIGS. 13 and 14, the seal 40 is a substantially rectangular block having a specified thickness along forward and backward directions and is constructed as a one-piece wire sealing plug. The seal 40 has wire insertion holes 41 of circular cross section that normally are in a large-diameter state to enable insertion of the female terminal fittings 13 and the wires 18 from behind. Inner circumferential surfaces of the wire insertion holes 41 are brought into close contact with the outer circumferential surfaces of the wires 18 to provide hermetic sealing between the seal 40 and the wires 18. The outer circumferential surface of the seal 40 closely contacts the inner circumferential surface of the fittable tube 12 to provide hermetic sealing between the seal 40 and the female housing 10.

The wire insertion holes 41 aligned in two rows at the right side have a larger diameter substantially corresponding to the female terminal fittings 13 for larger currents, and the wire insertion holes 41 aligned in six rows at the left side have a smaller diameter substantially corresponding to the female terminal fittings 13 for smaller currents. Three inner lips 42 are formed circumferentially on the inner circumferential surfaces of the respective wire insertion holes 41. Further, three outer lips 43 are formed circumferentially on the outer peripheral surface of the seal 40. During the sealing by the sealing member 40, the inner lips 42 are squeezed along the height direction by the wires 18, and the outer lips 43 also are squeezed along the height direction by the inner peripheral surface of the fittable tube 12.

The seal 40 is inserted into the front portion of the fittable tube 12 and then the base 51 of the rear holder 50 is inserted into the rear portion of the fittable tube 12. As a result, the rear surface of the seal 40 is pressed by the front pressing surface 51A of the base 51 of the rear holder 50. More particularly, the seal 40 is compressed in the thickness direction between the pressing surface 51A of the base 51 and the rear surface of the terminal accommodating portion 11 so that inside diameters of the wire insertion holes 41 are narrowed to bring the inner peripheral surfaces thereof into close contact with the wires 18.

Figure 15:
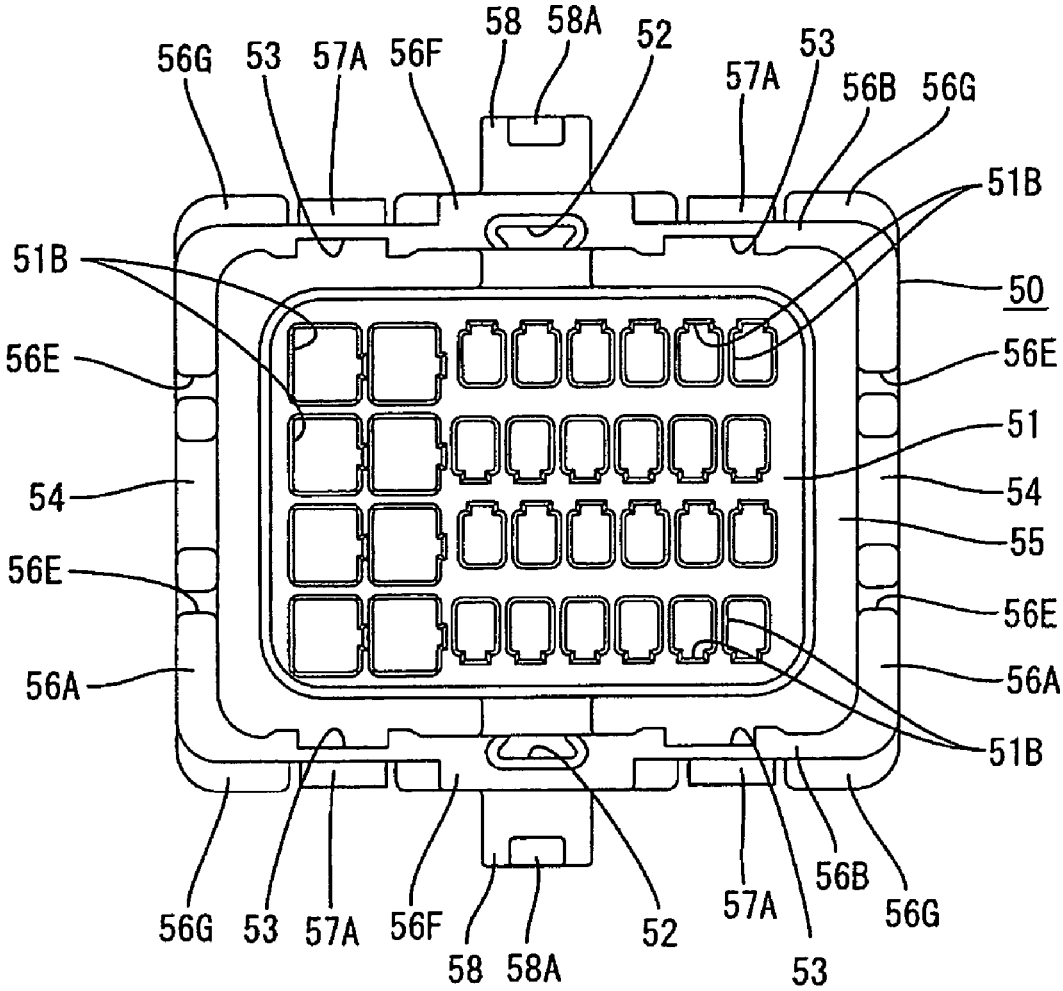
FIG. 15 is a front view of the rear holder.
Figure 16:
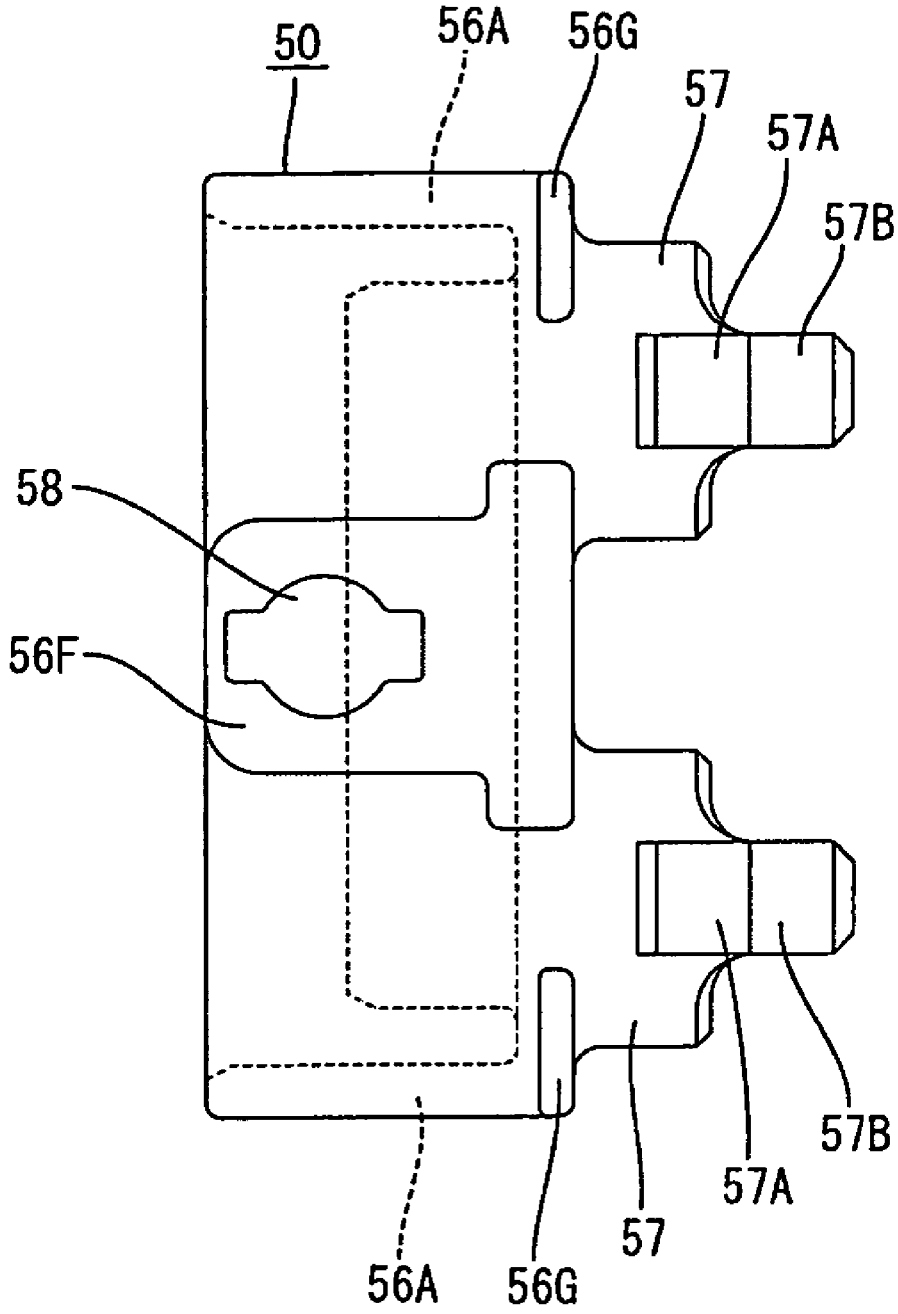
FIG. 16 is a plan view of the rear holder.
Figure 17:
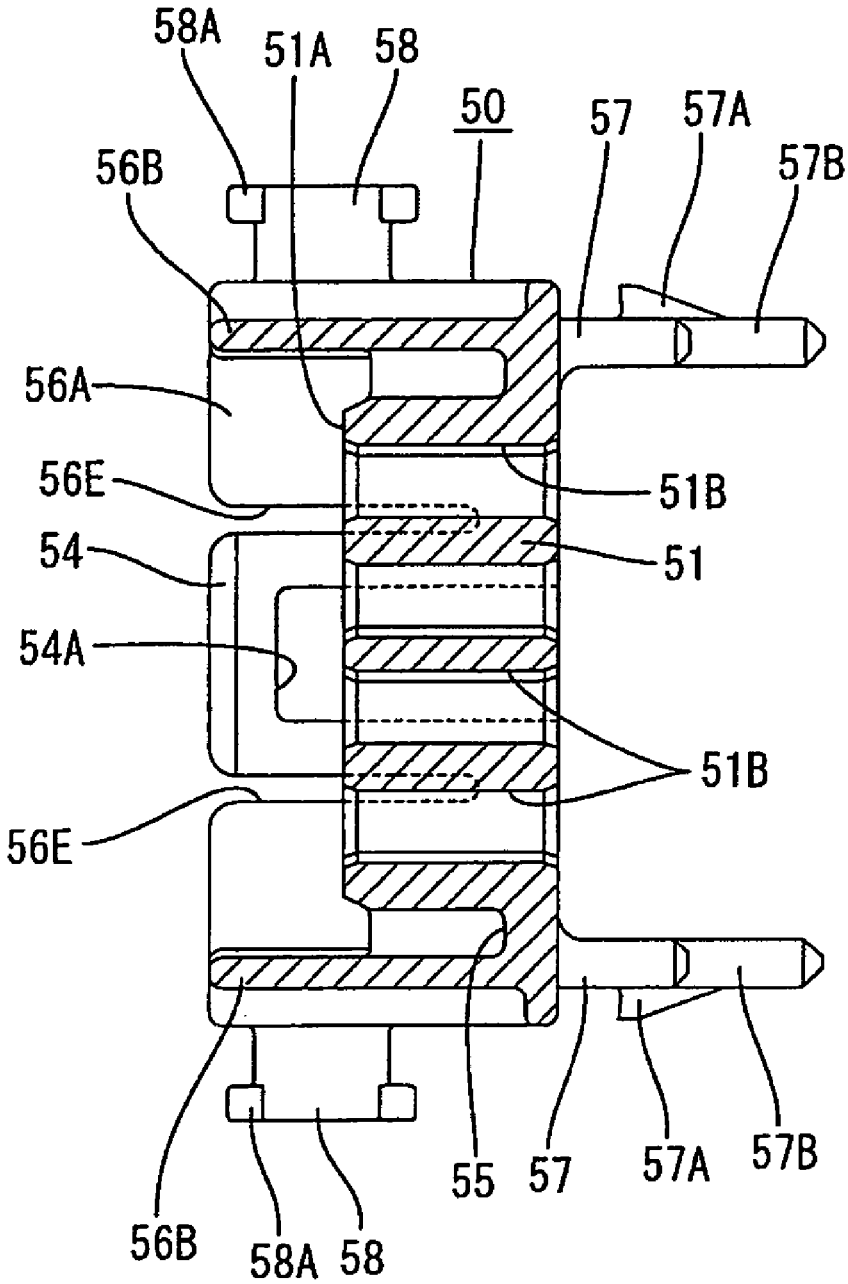
FIG. 17 is a side view in section of the rear holder.

As shown in FIGS. 15 to 17, the rear holder 50 is a cap having an open front surface. More particularly, the rear holder 50 has the rectangular block-shaped base 51 and a substantially plate-like projecting edge 55 extending at substantially at a right angle from the outer periphery of the rear end of the base 51. Side portions 56A, 56B project forward from the projecting end of the projecting edge 55, and substantially plate-like locking pieces 57 project back from the projecting end of the projecting edge 55. The inner peripheral surfaces of the sides 56A, 56B are spaced apart by a substantially constant distance from the outer peripheral surface of the base 51 over substantially the entire periphery to define a fitting space for receiving the surrounding wall of the fittable tube 12 from the front.

Insertion paths 51B are formed at positions of the base 51 substantially corresponding to the wire insertion holes 41 of the seal 40 and extend substantially in forward and backward directions. The insertion paths 51B are configured to receive the female terminal fittings 13 and the wires 18 inserted into the corresponding wire insertion holes 41. The insertion paths 51B have substantially rectangular cross sections one size larger than the box portions 13A. Thus, the female terminal fittings 13 and the wires 18 can be inserted loosely through insertion openings in the rear surface of the base 51.

Left and right side plates 56A and upper and lower lever mounting plates 56B are formed on the rear holder 50. Left and right engaging portions 54 are formed at middle parts of the opposite side plates 56A with respect to the height direction and are resiliently deformable in and out. Upper and lower slits 56E are formed at the front end of each side plate 56A and at opposite sides of the engaging portion 54 so that the engaging portion 54 can deform resiliently between the slits 56E. An engaging hole 54A is formed substantially in the center of each engaging portion 54. The engaging portions 54 move resiliently over the locking projections 17 as the rear holder 50 is fit on the fittable tube 12 to a proper depth, and the engaging holes 54A of the engaging portions 54 then engage the locking projections 17 when the rear holder 50 is fit on the fittable tube 12 to a proper depth. As a result the front surfaces of the locking projections 17 engage front edges of the engaging holes 54A. Clearances are left between the locking projections 17 and the opening edges of the engaging holes 54A. The rear holder 50 can slide within a range of these clearances when the movable member 70 reaches a final stage as described below.

As shown in FIG. 15, bulges 56F are formed at widthwise middle parts of both lever mounting plates 56B and are raised slightly with respect to the opposite sides thereof. Upper and lower rib receiving grooves 52 are formed in the bulges 56F and open in the front surface and the inner peripheral surface and extend in forward and backward directions. The rib receiving grooves 52 have dovetail shapes corresponding to the engaging ribs 15 of the fittable tube 12. The engagement of the rib receiving grooves 52 and the engaging ribs 15 prevents the lever mounting plates 56B from being disengaged from the female housing 10 even if forces act on the lever mounting plates 56B in directions to move them away from each other. Left and right guidable grooves 53 are formed at opposite sides of the rib receiving groove 52 of each lever mounting plate 56B and extend in forward and backward directions. The guidable grooves 53 are at positions substantially corresponding to the guiding portions 16 of the fittable tube 12 and open in the front surface and the inner peripheral surface. The rear holder 50 is fit to the fittable tube 12 while being slidably guided by the guides 16 and the engaging ribs 15.

Upper and lower pivot shafts 58 project from the outer peripheral surfaces of both bulges 56F for rotatably supporting the lever 70. Each pivot shaft 58 is cylindrical and front and rear widened portions 58A bulge out from the projecting end thereof for preventing the disengagement of the lever 70. Further, left and right temporarily holding portions 56G projects at the opposite lateral ends of the rear end of each lever mounting plate 56B.

Two locking pieces 57 project back from upper and lower sides of the projecting edge 55. The locking pieces 57 are substantially plate shaped and extend substantially parallel. Each locking piece 57 is resiliently deformable in and out and has a locking projection 57A on the outer side surface thereof. An engaging piece 57B is formed in an area of each locking piece 57 behind the locking projection 57A and has substantially the same width as the locking projection 57A.

Figure 18:
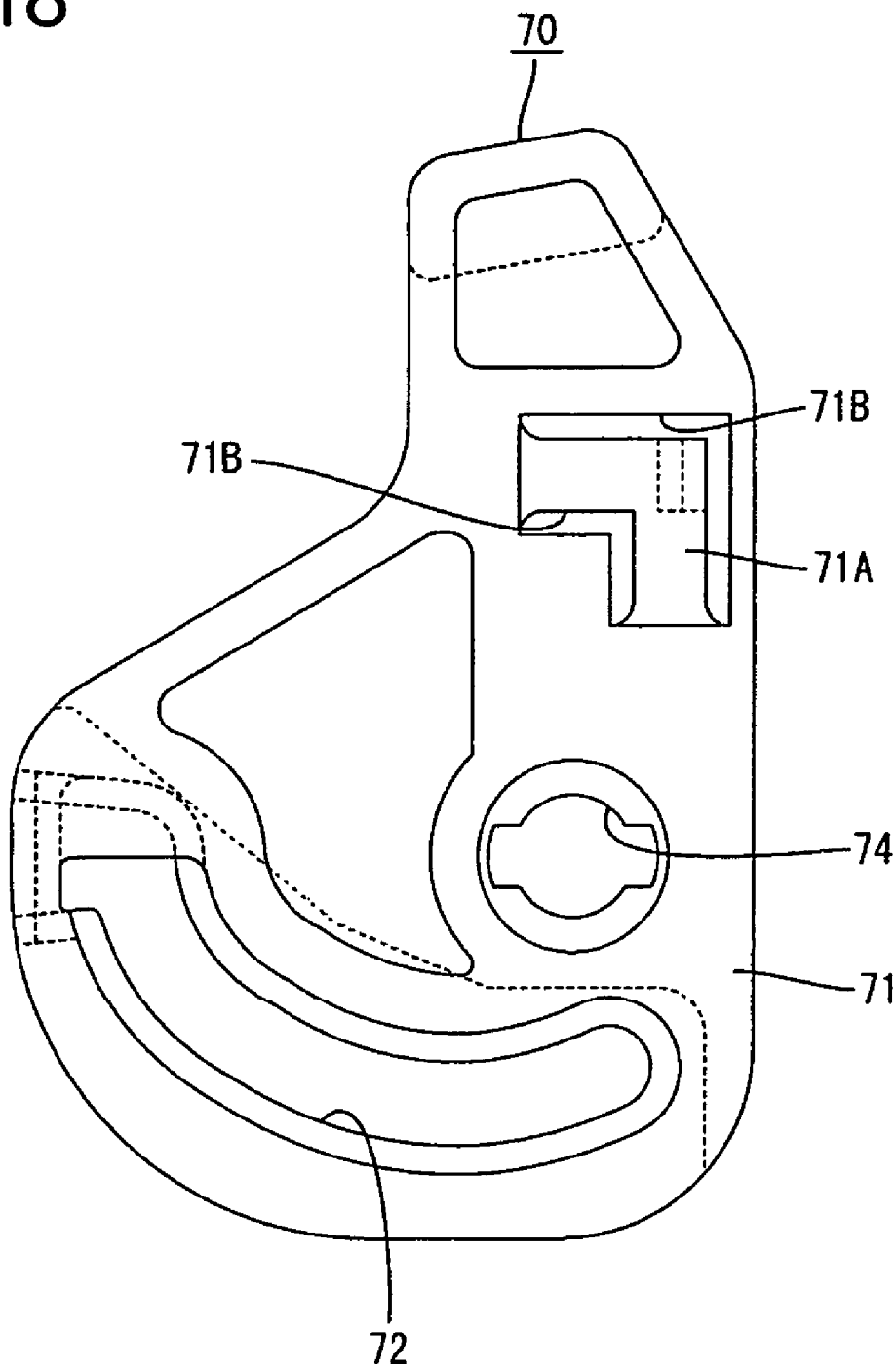
FIG. 18 is a plan view of the lever.
Figure 19:
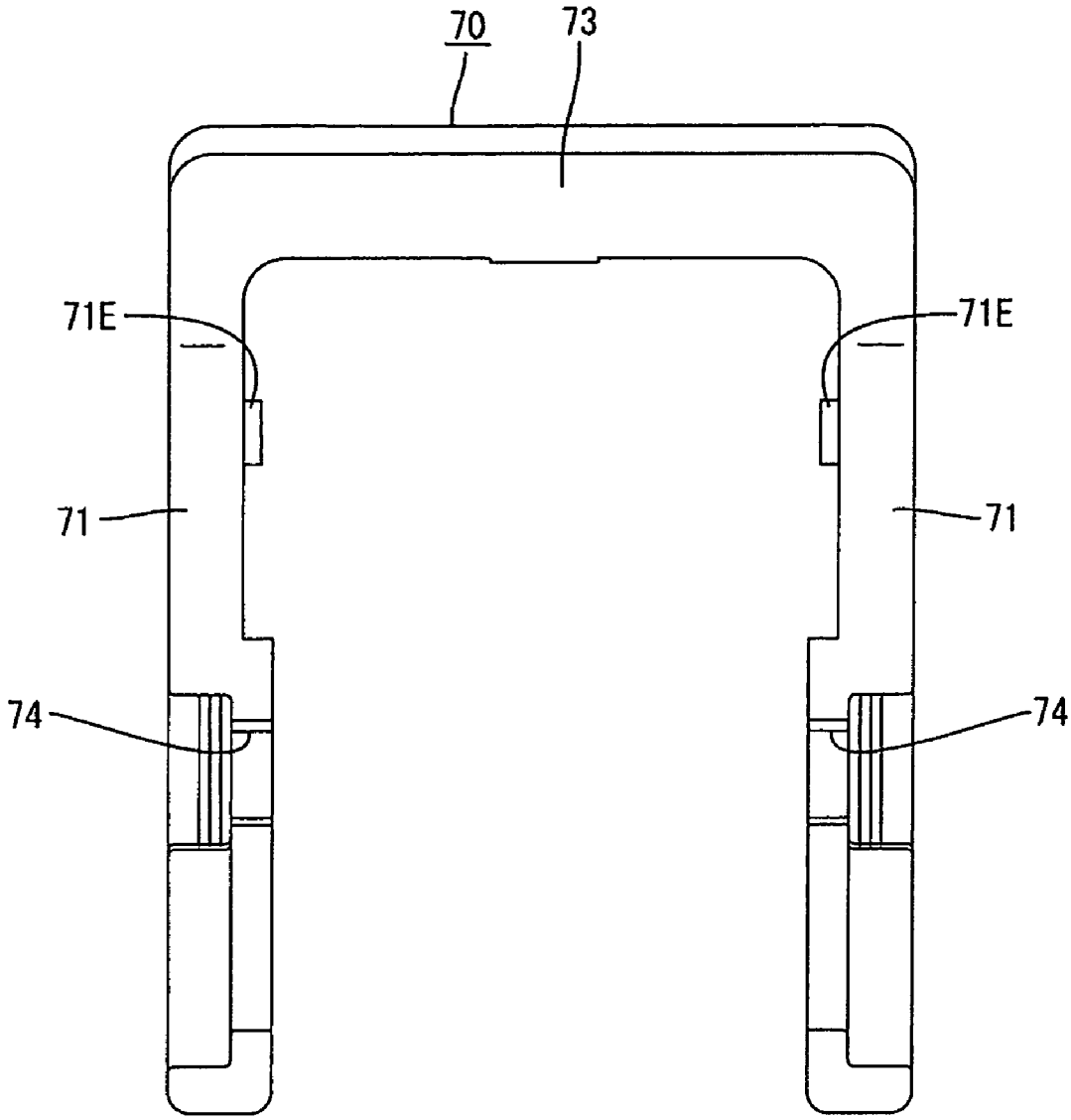
FIG. 19 is a front view of the lever.
Figure 20:
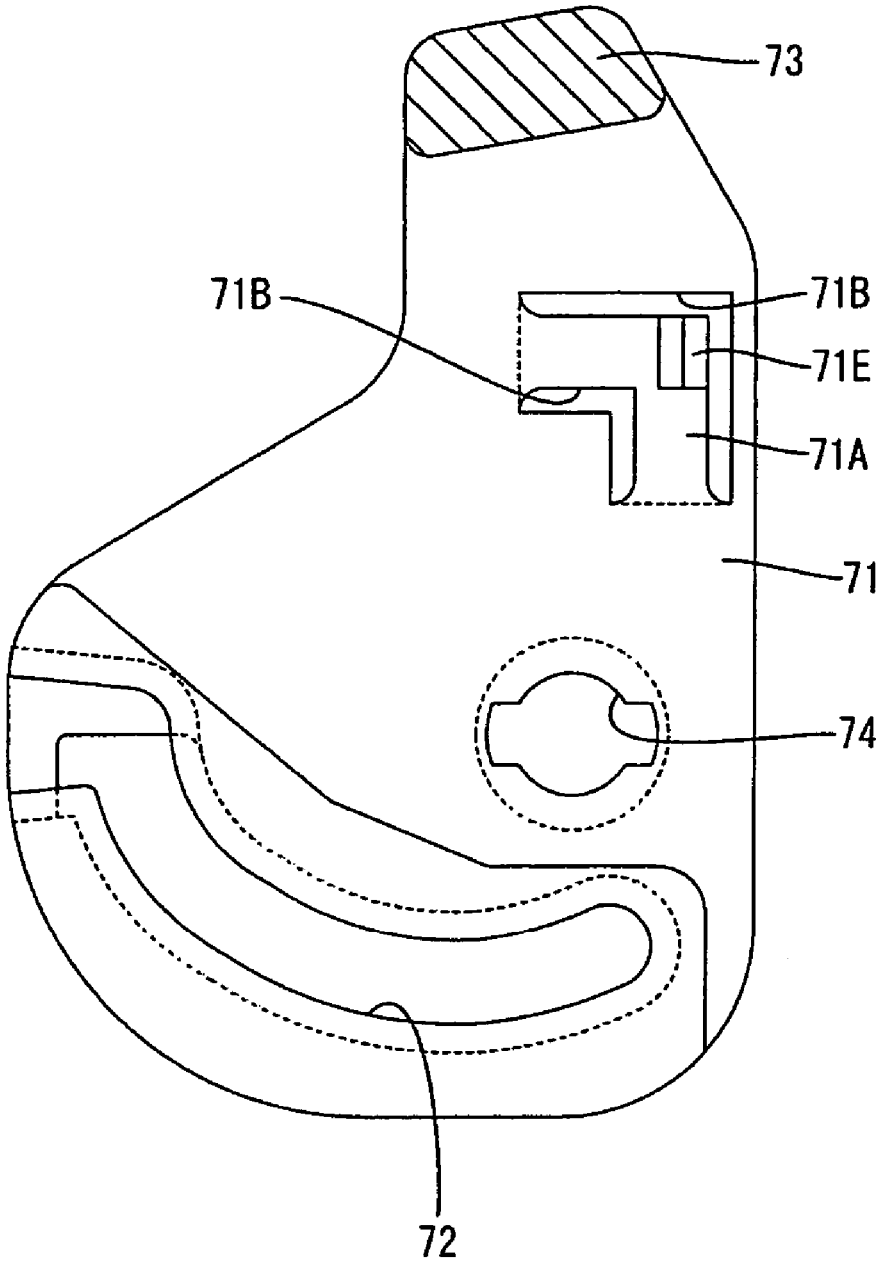
FIG. 20 is a horizontal section of the lever.

As shown in FIGS. 18 to 20, the lever 70 has two substantially parallel side plates 71, each of which is formed with a cam groove 72. The side plates 71 are joined by a coupling plate 73 that extends in a width direction. In other embodiments, the lever 70 may comprise only one side plate coupled to an operable portion. Left and right bearing holes 74 are formed in the side plates 71, and the pivot shafts 58 are fit securely into the bearing holes 74. The cam grooves 72 are curved and have openings in end of the respective side plates 72.

The outer surface of each side plate 71 has a substantially L-shaped thinned portion 71A. Two substantially parallel slits 71B are formed along the inner edges of the thinned portion 71A so that the thinned portion 71A can resiliently deform more easily. A projection 71E is formed on the inner surface of the thinned portion 71A.

The pivot shafts 58 of the rear holder 50 are inserted through the bearing holes 74 so that the lever 70 straddles the rear holder 50. Additionally the rear edges of the side plates 71 contact the temporarily holding portions 56G. In this way, the lever 70 is held at a rotation starting position. The cam pins 86 of the male housing 80 face the entrances of the cam grooves 72 when the housings 10, 80 are brought closer together. The coupling plate 73 then is operated to rotate the lever 70. As a result, the cam pins 86 move along the cam grooves 72 and the two housings 10, 80 are pulled towards each other to assist the connection. It should be noted that a deformation of the lever 70 to widen a spacing between the side plates 71 is prevented by the sliding contact of the flanges 86A of the cam pins 86 with inner peripheral portions 72A of the cam grooves 72.

The lever 70 can be rotated further after the housings 10, 80 have been connected. As a result, the base 51 of the rear holder 50 moves forward in the tube 12 and compresses the seal 40 in a thickness direction. Thus, a rotation stroke of the lever 70 is a sum of a stroke required to connect the two housings 10, 80 and a stroke required to compress the seal 40.

Figure 21:
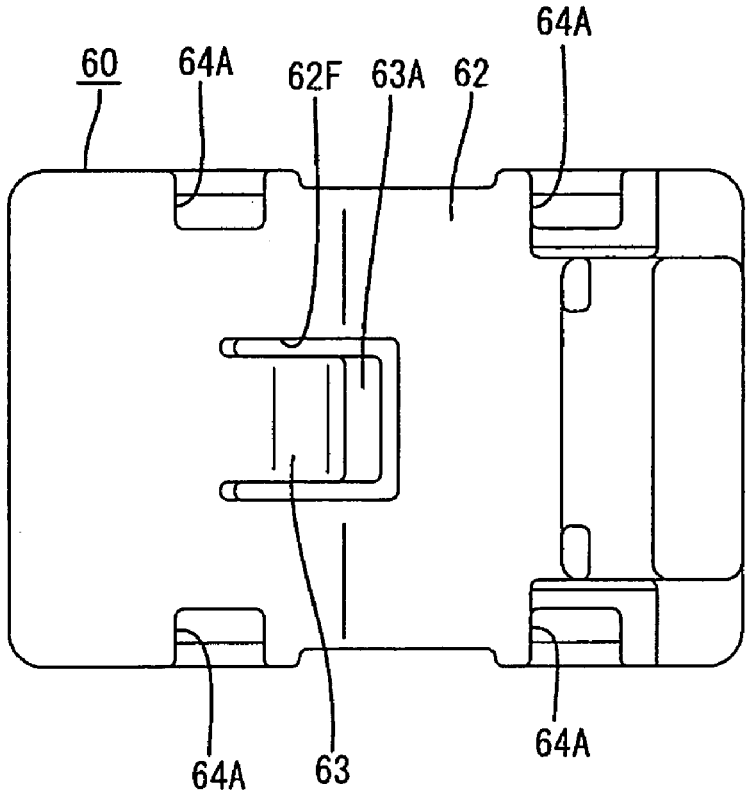
FIG. 21 is a plan view and a rear view of a wire cover.
Figure 21:
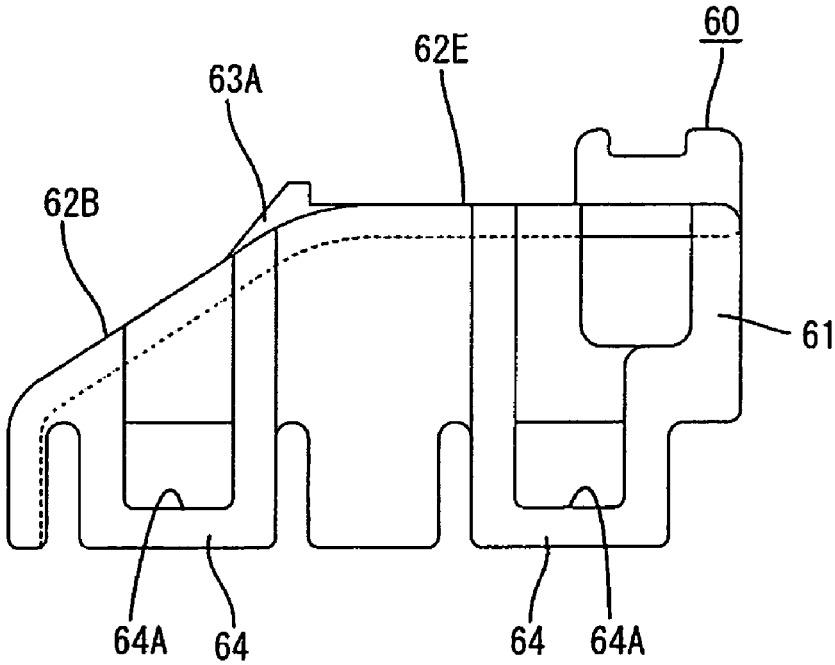

As shown in FIG. 21, the wire cover 60 is essentially a cap with upper and lower side walls 61 and a rear wall 62 that curves along the rear ends of the side walls 61. Wires drawn out through the rear surface of the rear holder 50 are guided by an inner surface 62A of the curved rear wall 62.

As shown in FIG. 21, an inclined surface 62B inclines up towards the front an outer surface of the rear wall 62 of the wire cover 60 at the left side, and a substantially straight surface 62E extends along a width direction on an outer surface of the rear wall 62. The coupling plate 73 of the lever 70 that has reached a rotation ending position contacts the straight surface 62E of the rear wall 62. A lever lock 63 is formed at a boundary between the straight surface 62E and the inclined surface 62B on the rear wall 62. The lever lock 63 is resiliently deformable in and out in a substantially U-shaped cut 62F in the rear wall 62, and a locking projection 63A is formed on the outer surface of the lever lock 63 for engaging the coupling plate 73 of the lever 70 in a returning direction of the lever 70.

Two resiliently deformable lock receiving pieces 64 project forward from each side wall 61. Each lock receiving piece 64 has a substantially U-shaped rim that surrounds a substantially rectangular lock receiving hole 64A. The lock receiving pieces 64 engage the locking pieces 57 of the rear holder 50 as the wire cover 60 is mounted and the locking projections 57A fit into the lock receiving holes 64A. Additionally, the engaging pieces 57B of the rear holder 50 pass through the lock receiving holes 64A and move onto the outer surfaces of the opposite side walls 61 as the wire cover 60 is mounted, whereas the leading ends of the lock receiving pieces 64 pass the opposite sides of the engaging pieces 57B to move onto the outer surfaces of the locking pieces 57. In this way, the locking pieces 57 and the lock receiving pieces 64 overlap in the thickness direction to lock the wire cover 60 strongly to the rear holder 50.

The connector is assembled by mounting the connector seal 90 from the front to the step 19 of the female housing 10. The front mask 20 then is slid sideways along the guiding grooves 11F of the terminal accommodating portion 11 and the front plate 23 of the front mask 20 is arranged on the front surface of the terminal accommodating portion 11. As a result, the connector seal 90 is squeezed between the front mask 20 and the step 19. Further, the arms 31 of the retainer 30 are inserted into the retainer mount hole 14 of the terminal accommodating portion 11 and the locks 34 hold the retainer 30 at the partial locking position.

The female terminal fittings 13 connected with the wires 18 are inserted through the insertion paths 51B of the rear holder 50, through the wire insertion holes 41 of the seal 40 and into the terminal accommodating chambers 11A of the female housing 10. The female terminal fittings 13 then are locked partly by the locks 11B. The retainer 30 then is inserted deeper so that the locking protrusions 33 of the arms 31 enter the corresponding terminal accommodating chambers 11A and fully lock the female terminal fittings 13. In other embodiments, the female terminal fittings 13 may be locked only by the locks 11B or only by the locking protrusions 33 rather than by both as in the illustrated embodiment.

The bearing holes 74 of the lever 70 then are supported rotatably on the pivot shafts 58 of the rear holder 50 so that the rear end of the lever 70 engages the temporarily holding portions 56G of the rear holder 50. The seal 40 then is fit into the accommodation space 12S of the fittable tube 12, and the base 51 of the rear holder 50 is fit on the fittable tube 12 from behind to place the sides 56A, 56B of the rear holder 50 on the outer peripheral surface of the fittable tube 12. As a result, the engaging portions 54 of the rear holder 50 resiliently engage the locking projections 17 of the fittable tube 12. In this state, the front surface of the seal 40 lightly touches the rear surface of the terminal accommodating portion 11, and the rear surface thereof lightly touches the pressing surface 51A of the base 51 of the rear holder 50. Thus, the seal 40 is mounted without being compressed in the thickness direction. Thereafter, the wire cover 60 is to be mounted on the rear holder 50 from behind. More particularly, the lock receiving pieces 64 of the wire cover 60 resiliently engage the respective locking pieces 57 of the rear holder 50; and the wires drawn out through the rear surface of the rear holder 50 are bent and guided at substantially a right angle by the inner surface 62A of the rear wall 62 of the wire cover 60.

Figure 5:
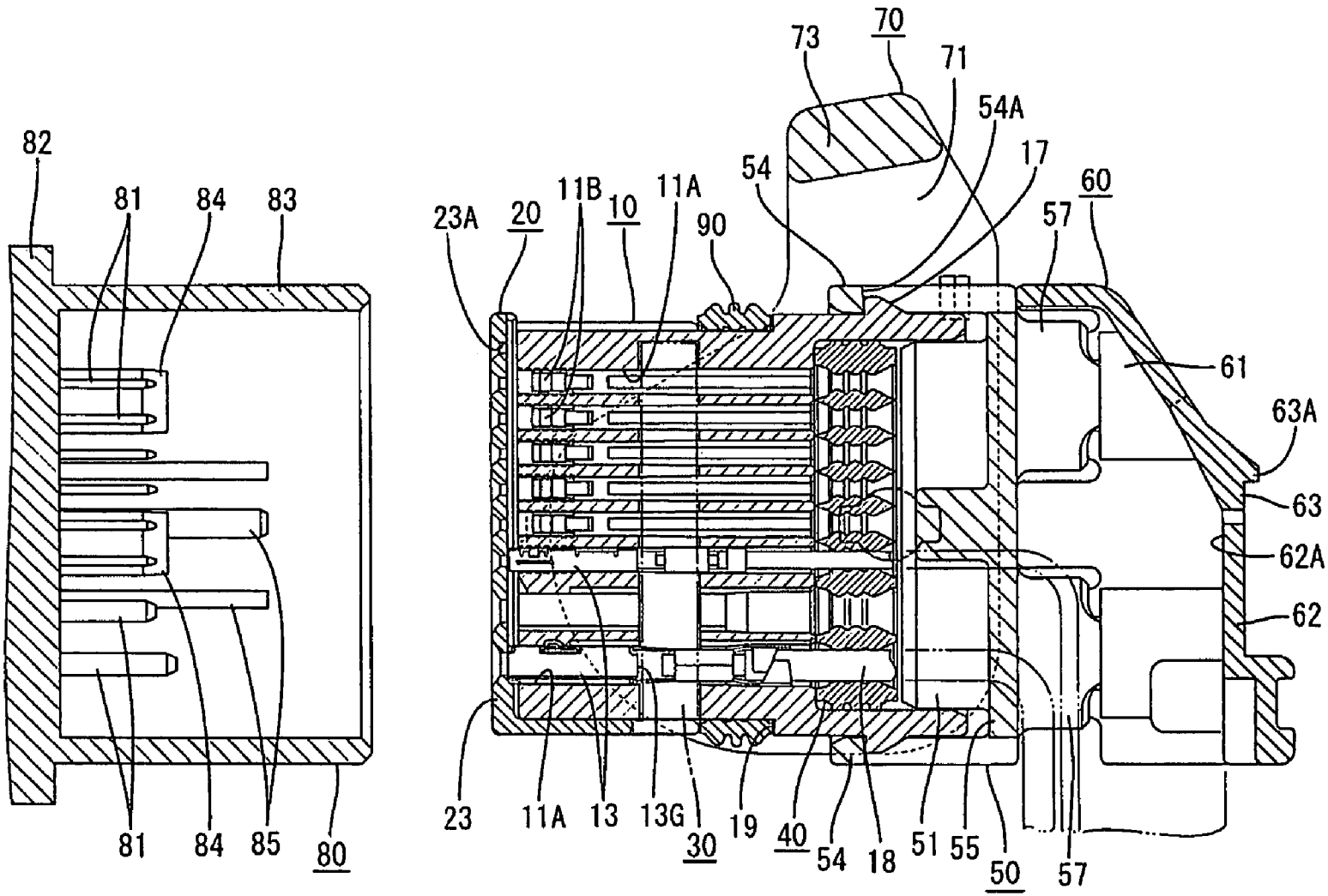
FIG. 5 is a horizontal section showing a state before the female housing is connected with the mating male housing.
Figure 6:
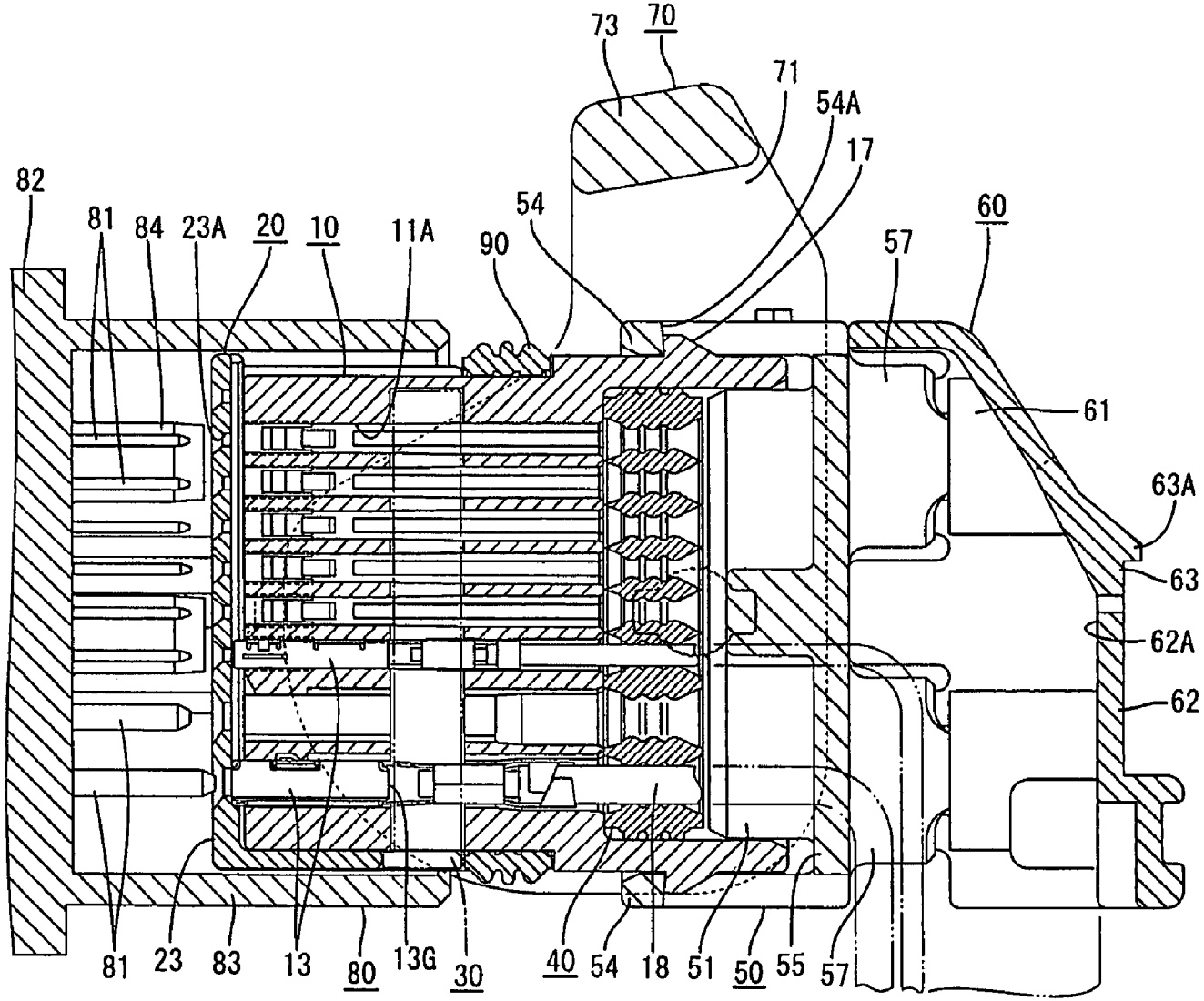
FIG. 6 is a horizontal section of an intermediate state while the female housing and the mating male housing are brought closer to each other.
Figure 7:
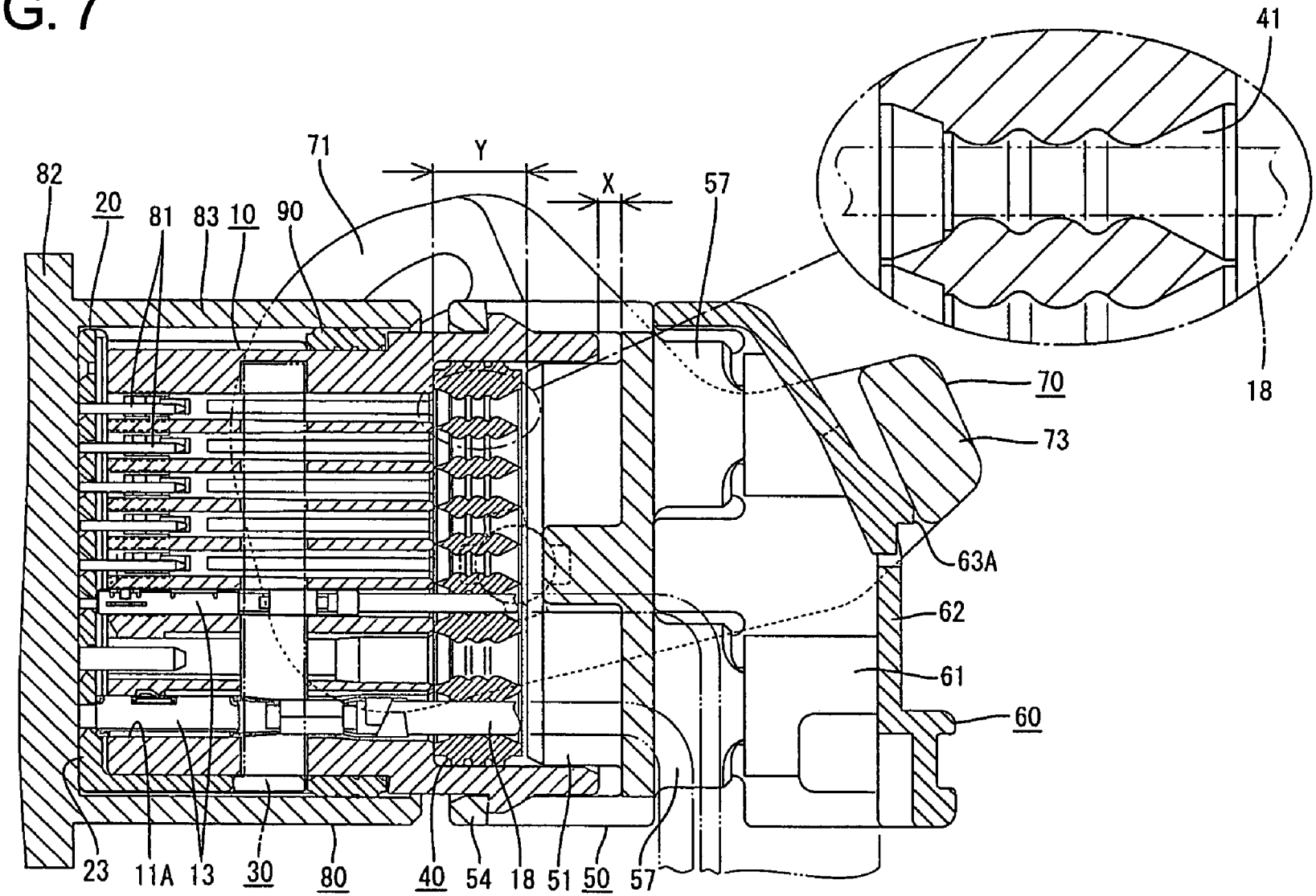
FIG. 7 is a horizontal section showing a state where the female housing and the mating male housing are properly connected.
Figure 8:
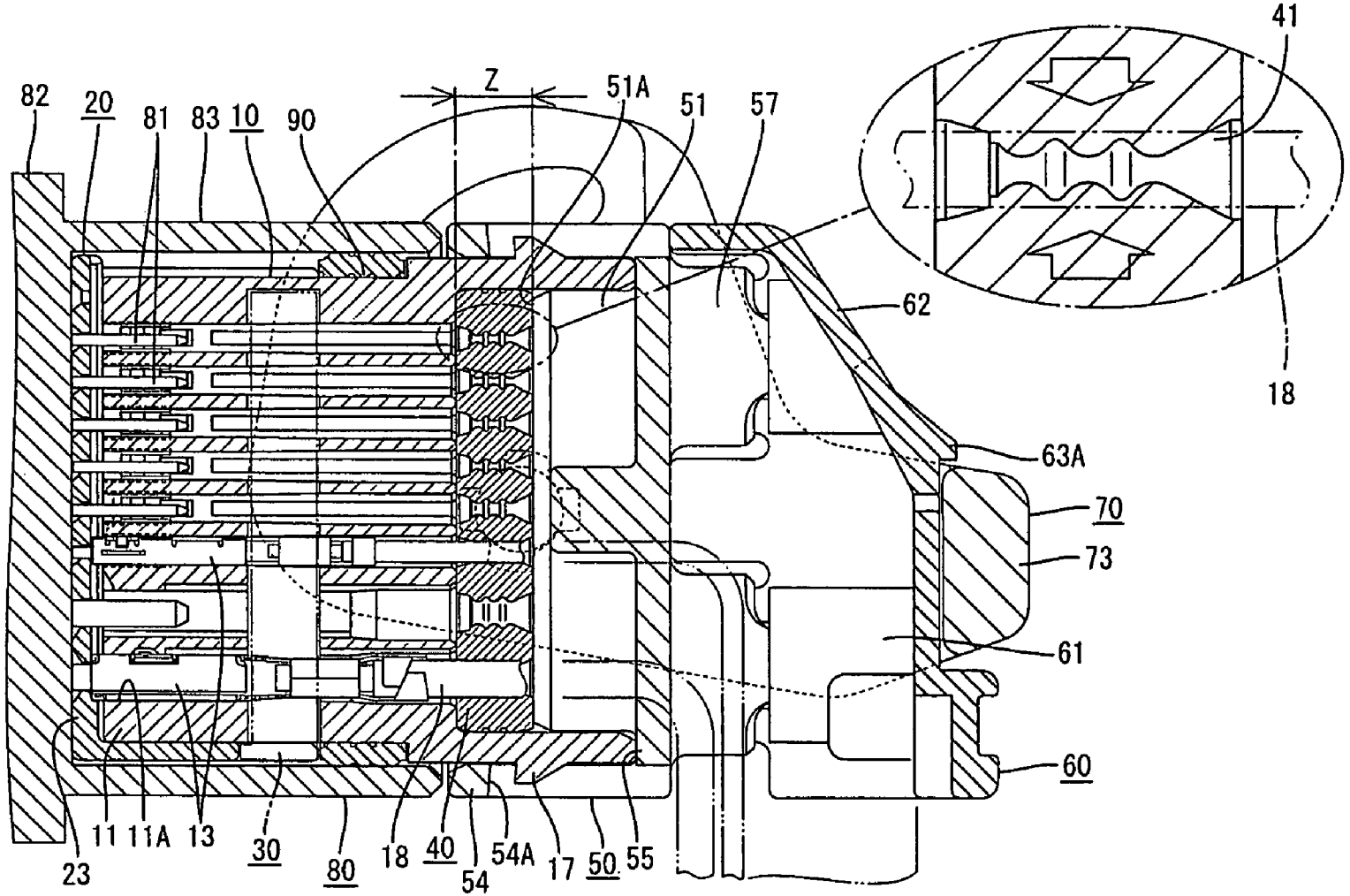
FIG. 8 is a horizontal section showing a state where a sealing member is compressed by a pressing surface of a rear holder.

The female housing 10 can be connected with the mating male housing 80 by positioning the receptacle 83 of the male housing 80 in opposed relationship to the terminal accommodating portion 11 from the front, as shown in FIGS. 1 and 5. The housings 10, 80 then are brought closer to each other so that the guiding ribs 85 of the receptacle 83 enter the rib receiving grooves 27 of the front mask 20 and so that the cam pins 86 of the receptacle 83 enter the cam grooves 72 of the lever 70 (see FIGS. 2 and 6). The lever 70 then is rotated by holding the coupling plate 73 of the lever 70. As a result, the two housings 10, 80 are pulled towards each other by a cam action of the cam pins 86 and the cam grooves 72. The front surface of the front mask 20 contacts the front surface of the terminal mounting portion 82 at an intermediate stage of the rotation of the lever 70 and while the cam pins 86 are still before the extending ends of the cam grooves 72. Thus, further approaching movement of the two housings 10, 80 is hindered (see FIGS. 3 and 7). In this properly connected state, the tabs 81 of the male terminal fittings are inserted to substantially proper depths in the box portions 13A of the female terminal fittings 13 and the male and female terminal fittings are connected electrically.

The lever 70 is rotated further towards the rotation ending position to slide the sides 56A, 56B of the rear holder 50 along the outer peripheral surface of the fittable tube 12 and to move the base 51 of the rear holder 50 forward in the accommodation space 12S of the fittable tube 12. Thus, the seal 40 is squeezed in the thickness direction between the pressing surface 51A of the base 51 and the back surface of the fittable tube 12. Accordingly, the inner circumferential surfaces of the wire insertion holes 41 have their diameters narrowed, and the wires 18 are fastened and sealed tightly in radially inward directions (see FIG. 8). The lever locking portion 63 of the wire cover 60 resiliently engages the rear edge of the lever 70 when the lever 70 reaches the rotation ending position to prevent a returning movement of the lever 70 and to prevent a separation of the two housings 10, 80 (see FIG. 4).

The thickness of the seal 40 is kept substantially constant until the two housings 10, 80 substantially reach a properly connected position. However, the thickness of the seal 40 is reduced to Z in FIG. 8 as the lever 70 is rotated from the properly connected position of the housings 10, 80 towards the rotation ending position. During this time, the locking projections 17 of the fittable tube 12 retract from the positions where they contact the front ends of the engaging holes 54A of the engaging portions 54, thereby defining clearances to the front ends of the engaging holes 54A. The rear end of the fittable tube 12 substantially abuts the front surface of the projecting edge 55 of the rear holder 50 when the lever 70 reaches the rotation ending position. Accordingly, a moved distance of the sides 56A, 56B of the rear holder 50 along the outer peripheral surface of the fittable tube 12, i.e. a compressed amount of the seal 40, can be determined by visually confirming the positions of the locking projections 17 and a displacement amount X (see FIG. 7) of the rear end of the fittable tube 12 with respect to the rear holder 50.

As described above, instead of being assembled directly to the female housing 10, the lever 70 is mounted on the rear holder 50 as a separate part. Thus, a construction to assemble the lever 70 is formed on the rear holder 50, with the mold for forming the female housing 10 can be simplified.

Further, the wire insertion holes 41 of the seal 40 are kept in a larger-diameter undeformed state before the lever 70 is rotated. Thus, the female terminal fittings 13 and the wires 18 can be inserted easily. On the other hand, after the lever 70 is rotated to connect the two housings 10, 80 properly, the base 51 of the rear holder 50 is moved forward to compress the seal 40 between the pressing surface 51A of the base 51 and the back surface of the fittable tube 12. Therefore the respective wire insertion holes 41 are deformed to have smaller diameters, and the wires 18 are held tightly in close contact with the inner circumferential surface of the wire insertion holes 41 to achieve secure sealing. As a result, it becomes possible to set larger hole diameters for the wire insertion holes 41 for accommodating larger female terminal fittings 13. Further, the inner circumferential surfaces of the larger wire insertion holes 41 and the hole edges of the seal 40 are less likely to be damaged upon inserting the female terminal fittings 13.

Figure 26:
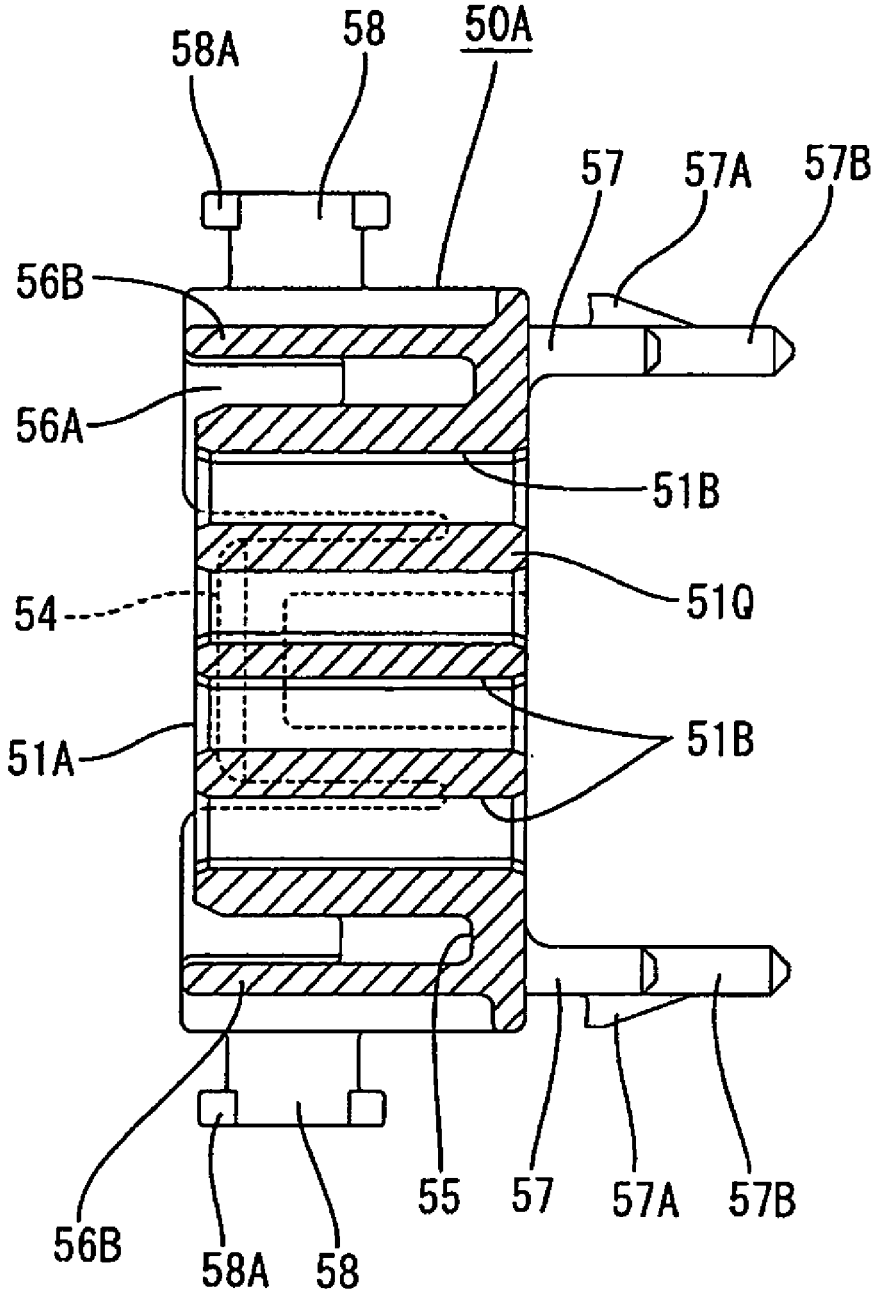
FIG. 26 is a side view in section of a rear member of a second embodiment.
Figure 27:
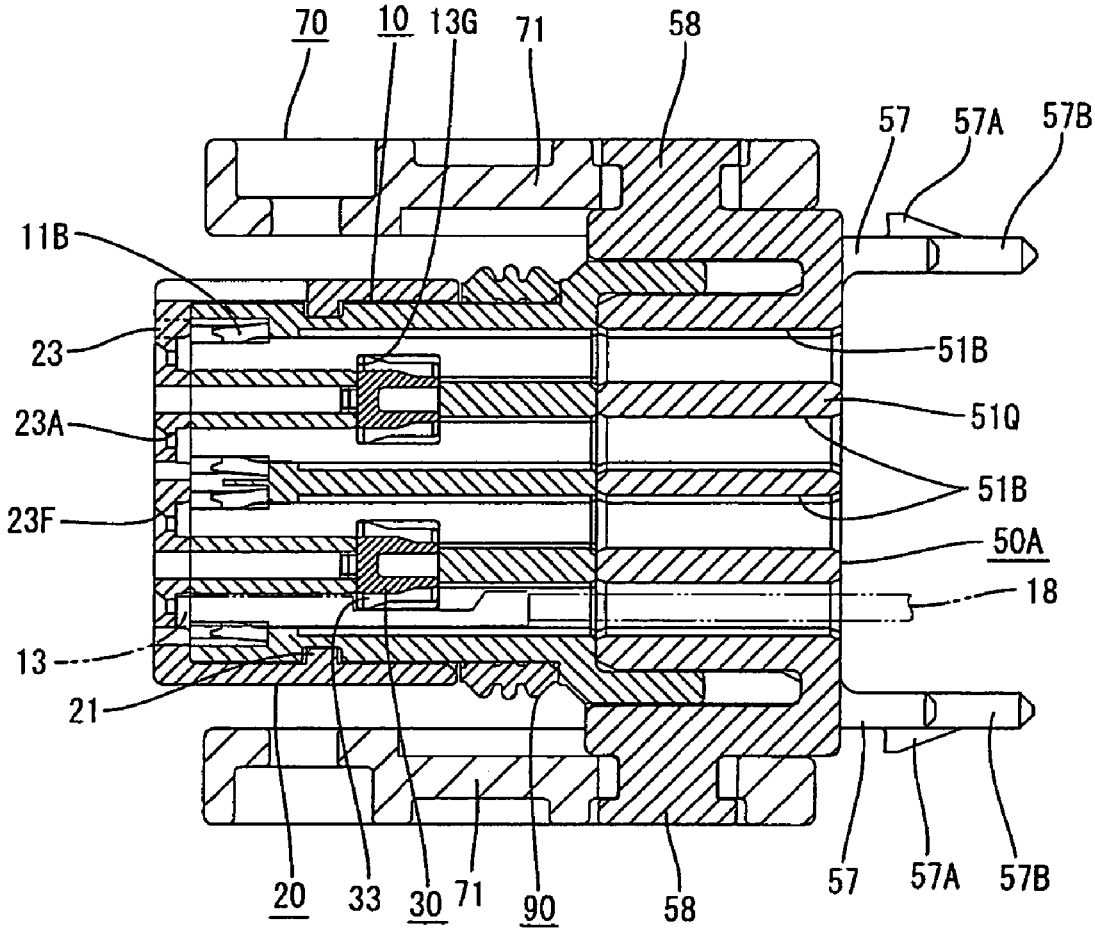
FIG. 27 is a side view in section of a connector.

A second embodiment of the invention is described with reference to FIGS. 26 and 27. A connector of the second embodiment is a nonwatertight connector, and has neither the seal 40 nor the connector seal 90. However, the connector of the second embodiment has parts that can interchange with the first embodiment. Specifically, the female housing 10, the front mask 20, the retainer 30, the lever 70 and the wire cover 60 are substantially identical to those of the first embodiment and these parts are not described again. However, the second embodiment has a rear part 50A that differs from the holder 50 of the first embodiment, as described herein.

The rear part 50A is essentially a cap with an open front. More particularly, the rear part 50A has a base 51Q, a projecting edge 55, sides 56A, 56B and locking pieces 57. The projecting edge 55, the sides 56A, 56B and the locking pieces 57 have the same shapes as those of the rear holder 50, and only the base 51Q differs from that of the rear holder 50.

More specifically, the length of the base portion 51Q along forward and backward directions is approximately a sum of the corresponding length of the base 51 and the thickness of the seal 40 in the undeflected state. Accordingly, the base 51Q can substantially the entire inner peripheral surface of accommodation space 12S of the fittable tube 12 of the female housing 10. As the base 51Q is extended, the entire length of the insertion paths 51B becomes longer than that in the first embodiment.

The female terminal fittings 13 and the wires 18 connected with the female terminal fittings 13 are inserted through one or more respective insertion openings in the rear surface of the base 51Q and further enter the terminal accommodating chambers 11A of the terminal accommodating portion 11 through the insertion paths 51B. The insertion paths 51B are substantially continuous in a lengthwise direction to the corresponding terminal accommodating chambers 11A. Thus, the female terminal fittings 13 have their inserting operations guided without interruption, thereby enabling smooth inserting operations.

The second embodiment is selected if watertightness is not required for a connector. Thus, the rear part 50A is fit into the accommodation space 12S of the fittable tube 12 of the female housing 10. On the other hand, the first embodiment is selected if watertightness is required. Thus, the seal 40 and the rear holder 50 are fit sequentially into the accommodation space 12S of the fittable tube 12. More specifically, two kinds of rear members, i.e. the rear holder 50 and the rear part 50A are prepared, and the appropriate rear member 50 or 50A is selected depending on the need for watertightness. As a result, the application of the connector can be selected in a wider range.

As described above, the female housing 10 can be used commonly by selecting the rear holder 50 or the rear part 50A depending on whether watertightness is required and mounting the selected one on the female housing 10. As a result, the number of kinds of parts can be reduced since connectors are not special products for the respective specifications.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The base of the rear holder has a considerable length along forward and backward directions in the first embodiment. However, the base may be plate-shaped according to the present invention.

The seal is not compressed in the thickness direction until the two housings are connected properly in the first embodiment. However, the seal may be compressed to a certain extent by the pressing surface of the rear holder before the two housings are connected properly. The lever then may be rotated to the rotation ending position so that the pressing surface of the rear holder presses the seal further to provide secure sealing.

The front mask, the retainer, the connector seal and the wire cover are provided in the first embodiment, some or all of them may not be provided according to the present invention.

The above-described connector has a rotatable lever for displaying a cam action to connect the housings. However, any other movable member or lever displaying a cam action but having a different path (such as a substantially linear, elliptic, bent or other path) such as a slider may be used according to the invention for connecting the housings.

What is claimed is:

1. An electrical connector, comprising:

a housing having opposite front and rear ends, terminal accommodating chambers extending through the housing for accommodating terminal fittings along an insertion direction, an accommodation space provided at the rear end of the housing;

a seal selectively positionable in the accommodation space and being held in close contact with a peripheral sealing surface of the accommodation space;

a first rear member formed separately from the housing and selectively mounted on the rear end of the housing, the rear member having insertion openings for receiving the terminal fittings along the insertion direction of the terminal fittings into the terminal accommodating chambers;

a second rear member selectively mountable to the housing when no seal is accommodated in the accommodation space, the second rear member including a base to be fit into the accommodation space and formed with insertion paths extending from insertion openings formed in the rear surface of the base to the corresponding terminal accommodating chambers; and a lever assembled with one of the first and second rear members and having at least one cam groove configured for receiving at least one cam pin formed on the mating housing and guiding the cam pin along the cam groove as the lever is rotated about at least one pivot shaft for connecting the housing with a mating housing through a cam action.

2. The connector of claim 1, wherein the seal is formed with wire insertion holes that normally are in a large-diameter state, so that the terminal fittings and wires connected with the terminal fittings can be inserted therethrough.

3. The connector of claim 2, wherein the rear member has a pressing surface for pressing a rear surface of the seal, the insertion openings in the rear member being dimensioned for loosely accommodating the terminal fittings and the wires and being aligned substantially with the respective wire insertion holes of the seal.

4. The connector of claim 2, wherein the pressing surface of the rear member is dimensioned to compress the seal in a thickness direction by operating the movable member after the two housings are connected for narrowing diameters of the wire insertion holes sufficiently to bring inner circumferential surfaces of the wire insertion holes into close contact with the wires in a hermetic manner.

5. The connector of claims 4, wherein the rear member includes a side for at least partly surrounding an outer peripheral surface of a rear part of the housing, the side being relatively displaceable along the outer peripheral surface of the rear part of the housing until the compression of the seal is completed.

* * * * *